US009546836B2

(12) United States Patent
Cottle et al.

(10) Patent No.: US 9,546,836 B2
(45) Date of Patent: Jan. 17, 2017

(54) SLIDE STOCK FOR FIREARM WITH RETRACTABLE LOCK PIN

(75) Inventors: Jeremiah Cottle, Moran, TX (US); David Compton, Abilene, TX (US)

(73) Assignee: Slide Fire Solutions LP, Moran, TX (US)

( * ) Notice: Subject to any disclaimer, the term of this patent is extended or adjusted under 35 U.S.C. 154(b) by 886 days.

(21) Appl. No.: 13/464,669

(22) Filed: May 4, 2012

(65) Prior Publication Data

US 2012/0240442 A1 Sep. 27, 2012

Related U.S. Application Data

(63) Continuation of application No. 13/335,731, filed on Dec. 22, 2011, now Pat. No. 8,176,835, which is a continuation-in-part of application No. 13/281,808, filed on Oct. 26, 2011, now Pat. No. 8,127,658, which is a continuation-in-part of application No.
(Continued)

(51) Int. Cl.

| | |
|---|---|
| ***F41A 19/03*** | (2006.01) |
| ***F41A 19/00*** | (2006.01) |
| ***F41A 19/11*** | (2006.01) |
| ***F41C 23/04*** | (2006.01) |
| ***F41C 23/14*** | (2006.01) |
| ***F41C 23/16*** | (2006.01) |
| ***F41C 23/20*** | (2006.01) |

(52) U.S. Cl.

CPC ..... *F41A 19/00* (2013.01); *F41A 19/11* (2013.01); *F41C 23/04* (2013.01); *F41C 23/14* (2013.01); *F41C 23/16* (2013.01); *F41C 23/20* (2013.01)

(58) Field of Classification Search

USPC ..... 42/69.01, 75.03, 106, 94, 71.01, 72, 73; 89/127, 128, 129.01, 129.02, 140, 136, 89/37.01, 37.03, 37.04

See application file for complete search history.

(56) References Cited

U.S. PATENT DOCUMENTS

| | | |
|---|---|---|
| 554,068 A | 2/1896 | Kimball |
| 981,210 A | 1/1911 | Menteyne et al. |

(Continued)

OTHER PUBLICATIONS

"[Archived Thread]—My Akins Accelerated 10/22 can kick your 10/22 ass . . . " Purported internet discussion thread. Aug. 13-22, 2006. (Copyright); Relevant pages may include p. 3 of 5. [http://www.ar15.com/forums/t_6_11/203814_.html].

(Continued)

*Primary Examiner* — Benjamin P Lee

(74) *Attorney, Agent, or Firm* — Endurance Law Group, PLC

(57) ABSTRACT

A bump stock and interface system for a semi-automatic firearm. In use, the user grasps a handle with one hand and places an index finger of the same hand firmly on a finger rest. When intending to fire a round of ammunition, the user pushes the firearm receiver forward with another hand so that the trigger collides with the immobilized finger on the finger rest. Recoil force separates the trigger from the user's finger on the finger rest. The user again pushes forward the receiver to repeat the firing cycle. A lock is selectively activated to arrest longitudinal movement of the firearm relative to the handle, thereby returning the firearm to normal semi-automatic functionality. The lock includes a retractable pin having a tip that rides in a track having a rear stop to limit over-travel of the handle.

20 Claims, 16 Drawing Sheets

Related U.S. Application Data

12/949,002, filed on Nov. 18, 2010, now Pat. No. 8,474,169.

(60) Provisional application No. 61/262,315, filed on Nov. 18, 2009.

(56) References Cited

U.S. PATENT DOCUMENTS

| | | | | |
|---|---|---|---|---|
| 1,447,861 | A | 3/1923 | Johnston | |
| 1,587,009 | A | 1/1926 | Bobbe | |
| 1,587,003 | A | 6/1926 | Kewish | |
| 2,220,663 | A | 11/1940 | Rossmanith | |
| 2,270,707 | A | 1/1942 | Humski | |
| 2,361,985 | A | 11/1944 | Birkigt | |
| 2,465,487 | A | 3/1949 | Sampson et al. | |
| 2,465,587 | A | 3/1949 | Sampson et al. | |
| 2,874,502 | A | 2/1959 | Lockwood | |
| 2,970,398 | A | 2/1961 | Crouch | |
| 3,031,786 | A | 5/1962 | Robert | |
| 3,507,067 | A | 4/1970 | Into | |
| 3,731,588 | A | 5/1973 | Curtis et al. | |
| 3,785,243 | A | 1/1974 | Christakos | |
| 4,002,101 | A | 1/1977 | Tellie | |
| 4,344,351 | A | 8/1982 | Mcqueen | |
| 4,532,852 | A | 8/1985 | Hance et al. | |
| 4,553,468 | A | 11/1985 | Castellano et al. | |
| 4,579,037 | A | 4/1986 | Gillum | |
| 4,601,123 | A | 7/1986 | Swearengen et al. | |
| 4,787,288 | A | 11/1988 | Miller | |
| 4,803,910 | A | 2/1989 | Troncoso | |
| 4,823,671 | A | 4/1989 | Buryta | |
| 5,074,190 | A | 12/1991 | Troncoso | |
| 5,092,052 | A | 3/1992 | Godsey | |
| 5,433,134 | A | 7/1995 | Leiter | |
| 5,630,406 | A | 5/1997 | Dumont | |
| 5,780,762 | A | 7/1998 | Kobayashi | |
| 5,852,691 | A | 12/1998 | Onishi et al. | |
| 5,852,891 | A | 12/1998 | Onishi et al. | |
| 5,979,098 | A | 11/1999 | Griggs | |
| 6,101,918 | A | 8/2000 | Akins | |
| 6,164,002 | A | 12/2000 | Troncoso | |
| 6,189,525 | B1 | 2/2001 | Kutrubes | |
| 6,318,014 | B1 | 11/2001 | Porter | |
| 6,807,762 | B1 | 10/2004 | Leung | |
| 6,807,763 | B1 | 10/2004 | Leung | |
| 6,966,138 | B1 | 11/2005 | Deckard | |
| 7,162,822 | B1 | 1/2007 | Heayn et al. | |
| 7,225,574 | B2 | 6/2007 | Crandall et al. | |
| 7,273,002 | B1 | 9/2007 | Rogers | |
| 7,340,857 | B1 | 3/2008 | Bentley | |
| 7,398,723 | B1 | 7/2008 | Blakely | |
| 7,562,614 | B2 | 7/2009 | Polston | |
| 7,596,900 | B2 | 10/2009 | Robinson et al. | |
| 7,805,873 | B2 | 10/2010 | Bentley | |
| 7,823,313 | B2 | 11/2010 | Faifer | |
| 7,966,760 | B2 | 6/2011 | Fitzpatrick et al. | |
| D645,110 | S | 9/2011 | Cook et al. | |
| 8,051,593 | B2 * | 11/2011 | Vesligai | 42/73 |
| 8,127,658 | B1 | 3/2012 | Cottle | |
| 8,176,835 | B1 | 5/2012 | Cottle | |
| 8,356,542 | B2 | 1/2013 | Cottle et al. | |
| 8,371,208 | B2 | 2/2013 | Cottle | |
| 8,448,562 | B2 | 5/2013 | Cottle | |
| 8,474,169 | B2 | 7/2013 | Cottle et al. | |
| 8,555,541 | B2 | 10/2013 | Ingram | |
| 8,607,687 | B2 | 12/2013 | Cottle | |
| 2005/0183312 | A1 | 8/2005 | Speaks | |
| 2005/0235546 | A1 | 10/2005 | Wonisch et al. | |
| 2006/0123683 | A1 | 6/2006 | Garrett et al. | |
| 2006/0248772 | A1 | 11/2006 | Curry | |
| 2007/0084101 | A1 | 4/2007 | Pikielny | |
| 2007/0138219 | A1 | 6/2007 | Kovalchuk et al. | |
| 2007/0261284 | A1 | 11/2007 | Keng | |
| 2007/0266845 | A1 | 11/2007 | Polston | |
| 2008/0110074 | A1 | 5/2008 | Bucholtz et al. | |
| 2009/0126249 | A1 | 5/2009 | Crommett | |
| 2009/0255161 | A1 | 10/2009 | Fitzpatrick et al. | |
| 2009/0313872 | A1 | 12/2009 | Goertz | |
| 2010/0071246 | A1 * | 3/2010 | Vesligai | 42/75.03 |
| 2010/0205846 | A1 | 8/2010 | Fitzpatrick et al. | |
| 2010/0229444 | A1 | 9/2010 | Faifer | |
| 2010/0242328 | A1 | 9/2010 | Faifer | |
| 2010/0242333 | A1 | 9/2010 | Kincel | |
| 2011/0067226 | A1 | 3/2011 | Westbrook | |
| 2011/0167704 | A1 | 7/2011 | Chupp | |
| 2011/0173863 | A1 | 7/2011 | Ingram | |
| 2011/0185618 | A1 | 8/2011 | Jamison et al. | |
| 2011/0225865 | A1 | 9/2011 | Williams | |
| 2011/0283587 | A1 | 11/2011 | Sharp et al. | |
| 2012/0000108 | A1 | 1/2012 | Zusman | |
| 2012/0000109 | A1 | 1/2012 | Zusman | |
| 2012/0042556 | A1 * | 2/2012 | Vesligaj | 42/75.03 |
| 2012/0186122 | A1 | 7/2012 | Zamlinsky et al. | |
| 2013/0097911 | A1 | 4/2013 | Larue | |
| 2013/0288204 | A1 | 10/2013 | Taylor | |

OTHER PUBLICATIONS

"Akins Accelerator Decision v 2.0"; Purported internet discussion thread. Jan. 9-Jun. 30, 2007. [http://thefiringline.com/forums/archive/index.php?t-234087.html].

"Another neutered Akins accelerator FS"; Purported internet discussion thread. Jan. 19-30, 2009. [http://1919a4.com/showthread.php?21872-Another-neutered-Akins-accelerator-FS].

"ATF reverses decision . . . "; Purported internet discussion thread. Dec. 6-24, 2006. [http://www.thehighroad.org/archive/index.php/t-240357.html].

"Bill_Akins > albums > Private concepts"; Purported video posted to internet. Oct. 16, 2008. [http://good-times.webshots.com/video/301122838009976397 0axOjzH].

"Just Wanted To Show Off My Bumpfiring Toy"; Purported internet discussion thread with embedded videos. Nov. 13, 2008-May 14, 2010; Relevant pages may include p. 1 of 2. [http://forum.saiga-12.com/index.php?/topic/31610-just-wanted-to-show-off-my-bumpfiring-toy-p/].

"More Thoughts on the Akins Accelerator"; Purported internet discussion thread. May 29, 2008-Sep. 25, 2009. [http://armsandthelaw.com/archives/2008/05/atkins_accelera.php].

"Screw the ATF and 1022"; Purported internet discussion thread. Apr. 10-11, 2007. [http://www.thehighroad.org/archive/index.php/t-268573.html].

"Turn In Your Killer Springs Here"; Purported internet discussion thread. Jan. 9-10, 2007. [http://www.thehighroad.org/archive/index.php/t-246764.html].

Michael Foeller II letter from US US Department of Justice, Bureau of Alcohol, Tobacco, Firearms and Explosives, Jun. 18, 2008.

Michael Johnson letter from US Department of Justice, Bureau of Alcohol, Tobacco, Firearms and Explosives, Jun. 26, 2008.

"Bump Firing"; Purported internet discussion thread. Jan. 21, 2004 by online user "Packrat".

"Can You Bump Fire a Ruger 10/22?"; Purported internet discussion thread. Mar. 7, 2007 by online user "rugerdude".

"Hellfire System"; Purported internet discussion thread. Mar. 31, 1997 by online user "GOJPO".

* cited by examiner

FIG. 10
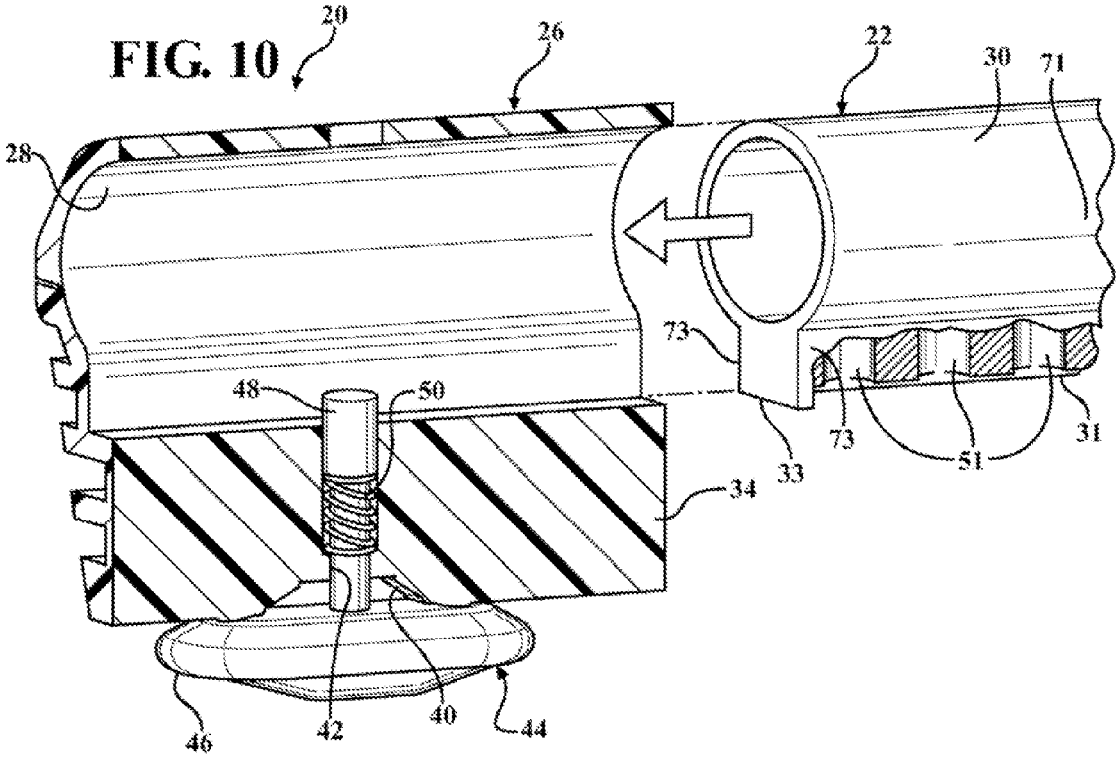
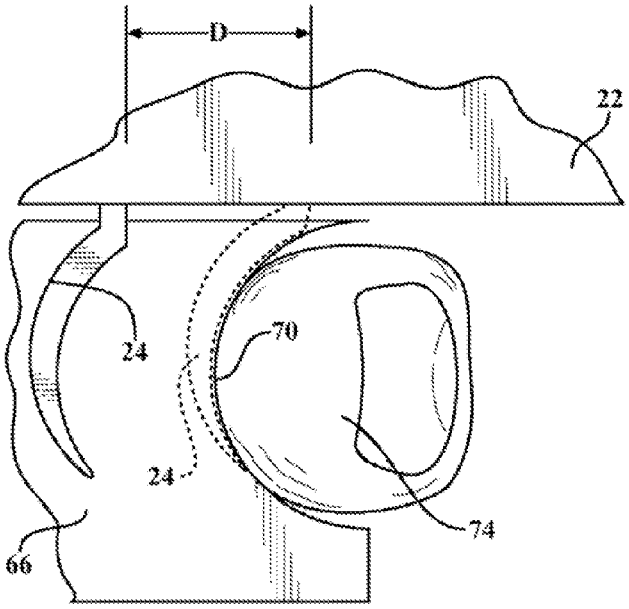
FIG. 11

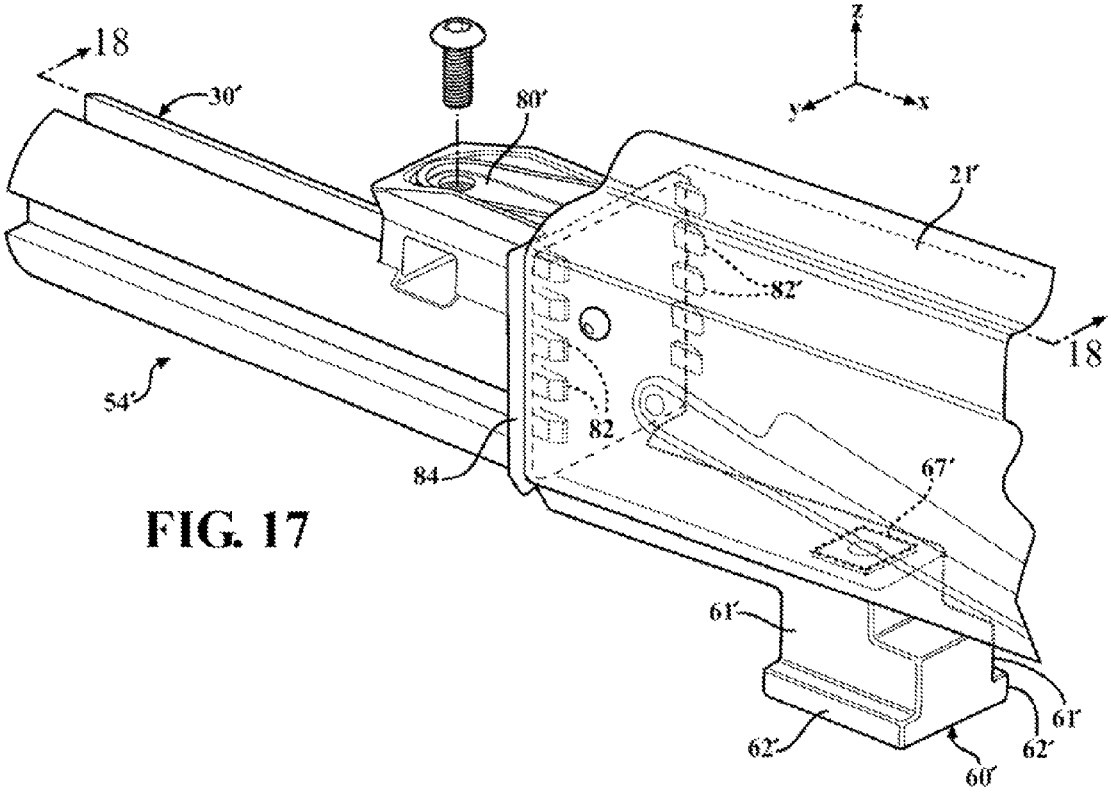
FIG. 17
FIG. 18
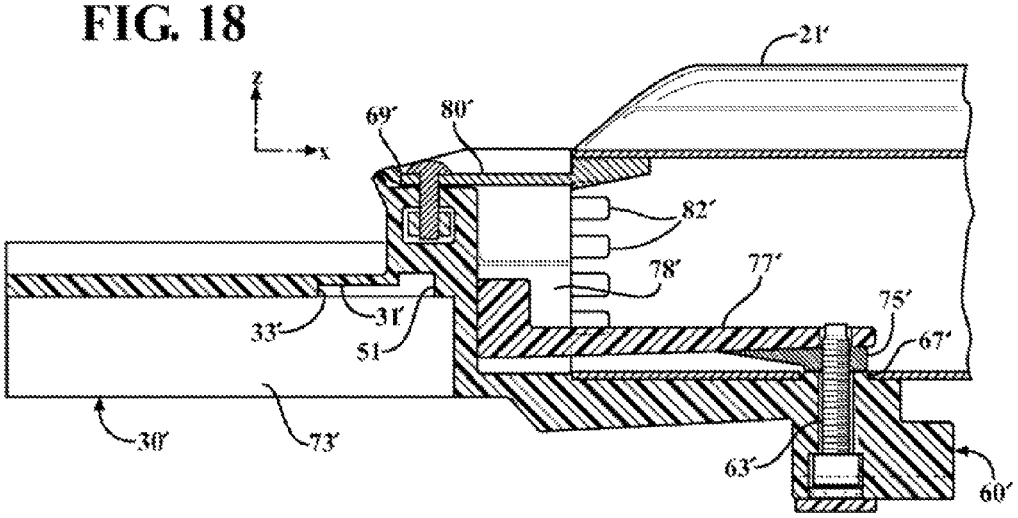

SLIDE STOCK FOR FIREARM WITH RETRACTABLE LOCK PIN

CROSS REFERENCE TO RELATED APPLICATIONS

This application is a Continuation of U.S. Ser. No. 13/335,731, filed Dec. 22, 2011, now U.S. Pat. No. 8,176,835, which is a Continuation-In-Part of U.S. Ser. No. 13/281,808, filed Oct. 26, 2011, now U.S. Pat. No. 8,127,658, which is a Continuation-In-Part of U.S. Ser. No. 12/949,002, filed Nov. 18, 2010, now US2011/0113665, which claims the benefit of U.S. Provisional Application Ser. No. 61/262,315 filed Nov. 18, 2009.

BACKGROUND

Field of the Invention

The present invention relates generally to firearms, and more particularly toward a manually reciprocated bump-stock accessory for semi-automatic firearms.

Related Art

Various techniques and devices have been developed to increase the firing rate of semi-automatic firearms. Many of these techniques and devices make use of the concept known as "bump firing", which is the manipulation of the recoil of the firearm to rapidly activate the trigger. One such bump firing technique is known as the "belt loop" method. To execute the belt loop method, the operator first places the firearm next to his or her hip and hooks one finger through both the trigger mechanism and a belt loop in the his or her clothing. The opposite hand is placed on the hand guard, which is attached to the barrel of the firearm. When the firearm is pushed forward by the operator, the trigger is activated by the finger to discharge a bullet. The recoil from the bullet pushes the firearm backwards away from the trigger finger, allowing the trigger to re-set. Forward force must be applied to the hand guard in order to activate the firing mechanism for each round that is fired. However, this may be achieved in very rapid succession.

Although able to achieve a high rate of firing, the belt loop has many safety and accuracy issues. For example, to correctly operate many firearms with the belt loop method, the operator's arm must be placed in the path of hot gasses being expelled from the ejection port of the firearm. This could lead to skin burns or possibly pinch the operator's sleeve or skin in the action. Another issue with the belt loop method arises because the operator cannot have a firm grip on the stock or the pistol grip of the firearm. Because the belt loop method only works if the firearm is held loosely with one hand, and the chances of the operator losing control of the firearm are greatly amplified. Because of this unnatural and unbalanced firing grip, the firearm is very difficult to aim and control during the belt loop method.

Commercial devices are also available for assisting in the bump firing concept, including the HELLSTORM 2000 and TAC Trigger. Both of these are small devices that mount to the trigger guard of the firearm and use springs to aid in quickly resetting the trigger while the firearm is bump fired, as described above. However, the same safety and accuracy issues of the belt loop method apply to these devices because the firearm cannot be held securely with the trigger hand or the stock of the firearm.

Another device for increasing the firing rate of a semi-automatic firearm is shown in U.S. Pat. No. 6,101,918, issued to Akins on Aug. 15, 2000 ("Akins '918"). Akins '918 shows a handle for rapidly firing a semi-automatic firearm having a trigger. The handle of Akins '918 extends from the stock all the way to the barrel of the firearm and a spring rod guide system supports the receiver and barrel of the firearm for longitudinal movement of the firearm relative to the handle. The handle includes a grip portion for holding the firearm. Springs are disposed between the handle and the firearm for continuously biasing the firearm in a forward direction. The handle further includes a finger rest against which the shooter's trigger finger stops after the trigger is initially pulled. In operation, the operator places their trigger finger (typically an index finger) against a trigger and gently squeezes or pulls the trigger rearwardly to discharge a first bullet. The recoil of the firearm forces the receiver and trigger mechanism longitudinally backward relative to the handle at the same time the shooter's trigger finger lands in a stationary position against the rest. The springs are carefully sized to the ammunition so as to be easily overcome by the recoil energy of a fired bullet. Continued rearward movement of the receiver and trigger assembly under the influence of recoil creates a physical separation between the shooter's finger (now immobilized by the rest) and the trigger, thus allowing the trigger mechanism of the firearm to automatically reset. As the recoil energy subsides, the constant biasing force of the springs eventually becomes sufficient to return the receiver and trigger portions of the firearm back to the starting position without any assistance from the operator. In the meantime, if the operator's trigger finger remains immobilized while the springs push the firearm back to its starting position, the reset trigger will collide with the finger and automatically cause the firearm to discharge another round, thus repeating the firing cycle described above. So long as the shooter's finger remains in place against the rest and there is an ample supply of ammunition, the firearm will continue firing rapid successive rounds without any additional human interaction or effort. One significant drawback of the Akins '918 construction is that automatic mechanisms of this type have been scrutinized for violating federal firearms laws. Another drawback is that different spring sizes (i.e., different resistance characteristics) may be required from one unit to the next depending on the type of ammunition used so that the springs do not overpower the recoil energy. This of course introduces inventory complexities.

A still further example of non-conventional shooting methods may be found by reference to U.S. Pat. No. 7,225,574 to Crandall et al., issued Jun. 5, 2007. In this case, which is not intended for semi-automatic type firearms, a shooter's muscle power is used to shuttle portions of a firing unit back and forth much like a traditional pump-action shotgun. A trigger mechanism is configured to be stimulated on the rearward pull-stroke, causing the ammunition to discharge. The forward push-stroke results in ejection of the spent shell casing. One particular disadvantage of this arrangement is that the natural recoil force generated by the discharge event is compounded by the shooter's pull-stroke. This may have a disadvantageous effect on aiming accuracy, particularly in rapid, multi-round volley shooting scenarios. It will therefore be appreciated that the shooting method of Crandall et al. is not conducive to rapid fire shooting as is common with semi-automatic firearms.

There exists a continuing need for further improvements in devices allow the operator to practice new and interesting ways to shoot firearms in a legal and safe manner, to increase the firing rate of semi-automatic firearms without compromising the safety of the operator or the accuracy of the firearm, which are generally universally functional without respect to ammunition type, and which are sufficiently distinguished from a fully automatic weapon so as to fall within compliance of federal firearms regulations. There exists further a need for an improved interface device or system disposed operatively between the firing unit of a firearm and the rear stock or grip portion of a firearm that is durable, sturdy, and not prone to binding in use.

SUMMARY OF THE INVENTION AND ADVANTAGES

According to an aspect of this invention, a bump-stock for a semi-automatic firearm includes a handle adapted to be grasped by a user's hand. The handle including a finger rest. The finger rest extends forwardly from the handle and is configured to stabilize the end of a user's trigger finger in a partially extended condition so that in use the user's trigger finger stretches in front of the trigger while the remaining fingers of the user's hand grasp the handle. The finger rest and the handle are moveable together as a unit. The handle includes an opposing surface for directly interacting with a bearing element of the firearm so that the finger rest and the handle are able to reciprocate in concert relative to the firearm trigger back-and-forth along a constrained linear path. A lock is movable toward and away from a locked position for selectively stopping reciprocating movement of the finger rest relative to the firearm trigger.

The present invention allows the operator of a semi-automatic firearm to switch between modes of rapid repeat firing and standard semi-automatic firing. The bump-stock can be designed for use with a wide range of semi-automatic firearm types, including both rifles and pistols to enable a new and exciting shooting style that will add enjoyment and excitement to the sport of shooting firearms.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 10 is a fragmentary cross-sectional view through a portion of the handle showing the interaction of the second bearing element with the handle and with the lock feature according to one embodiment of the invention;

FIG. 11 is an enlarged, fragmentary side view showing a human finger stabilized on the trigger guard and a nearby trigger of the firearm;

FIG. 17 is a perspective view of the firearm receiver of FIG. 16 showing an interface system engaged thereto with a mated fit directly behind the trigger (not shown);

FIG. 18 is a longitudinal cross-section through the interface system and receiver as taken generally along lines 18-18 in FIG. 17;

DETAILED DESCRIPTION OF THE INVENTION

Figure 1:
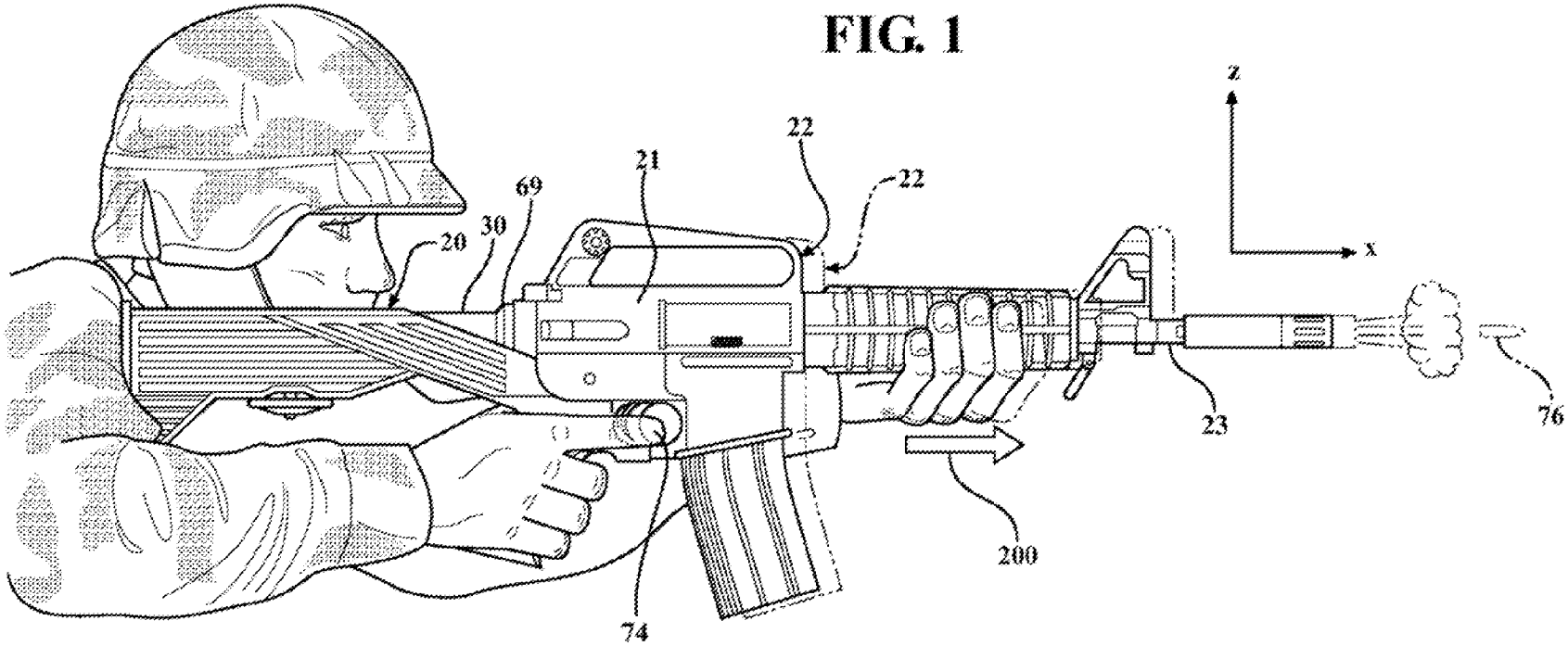
FIG. 1 shows a user holding a firing unit that is slidably supported in a handle according to one embodiment of this invention, with the firing unit shown in phantom advanced forwardly to discharge a round of ammunition according to the firing method of this invention.
Figure 2:
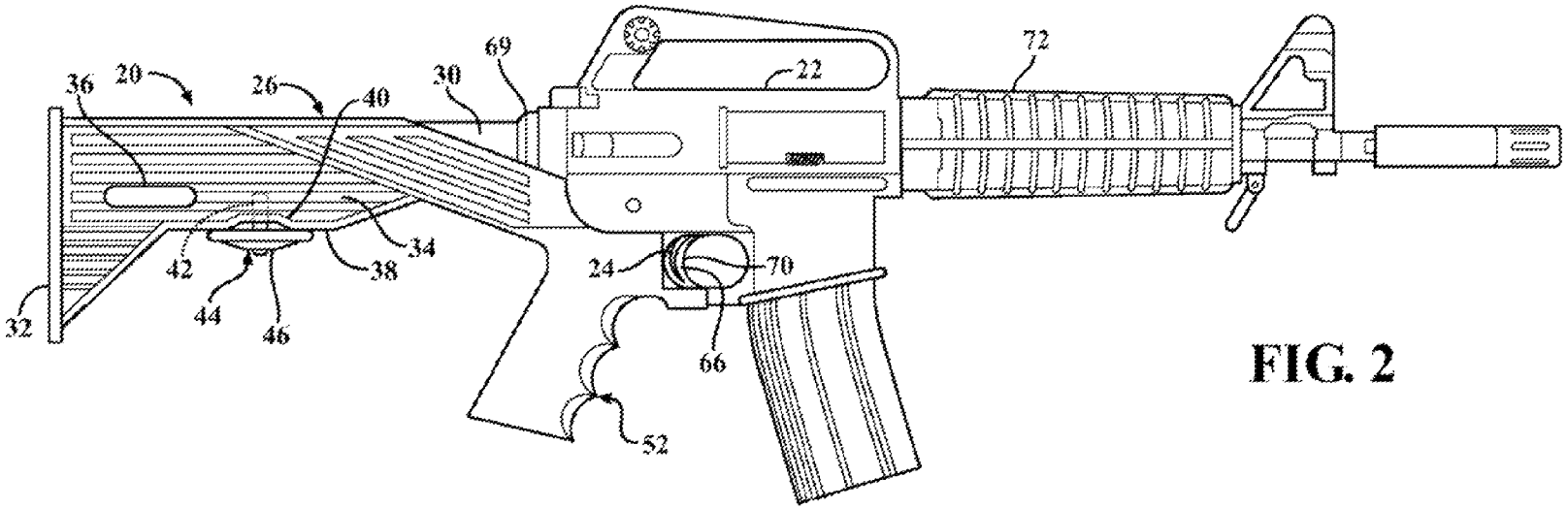
FIG. 2 is a left side view of the first exemplary embodiment of the handle supporting an AR-15 firing unit.
Figure 3:
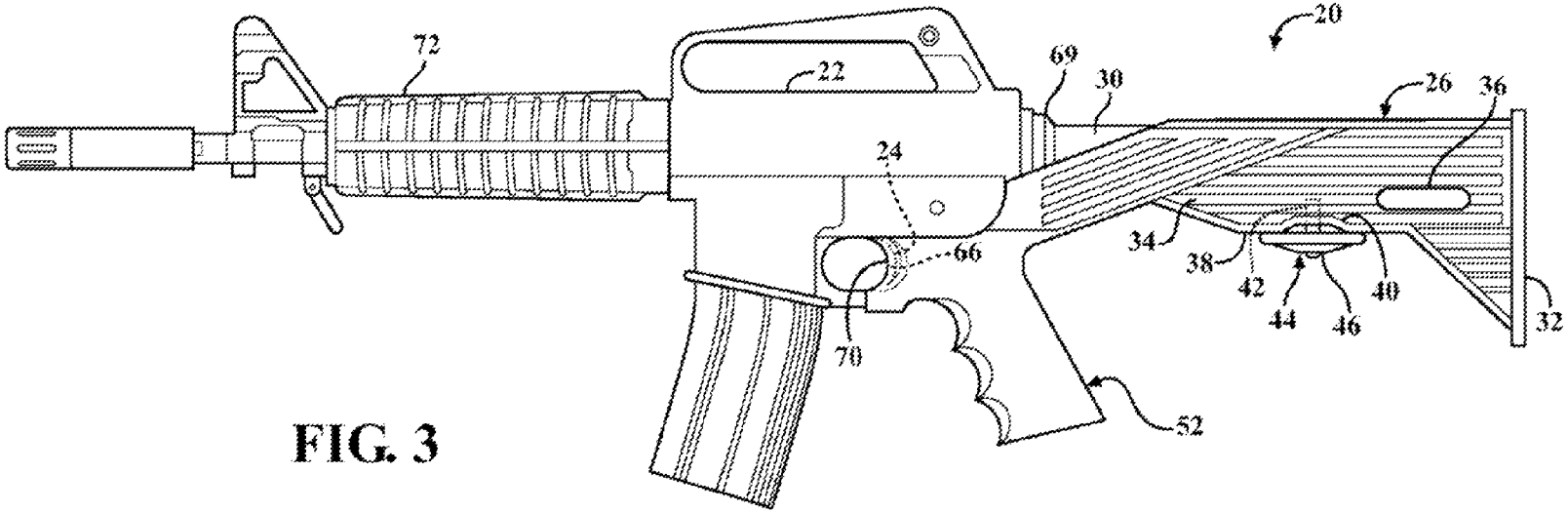
FIG. 3 is a right side view of the first exemplary embodiment of the handle supporting an AR-15 firing unit.
Figure 4:
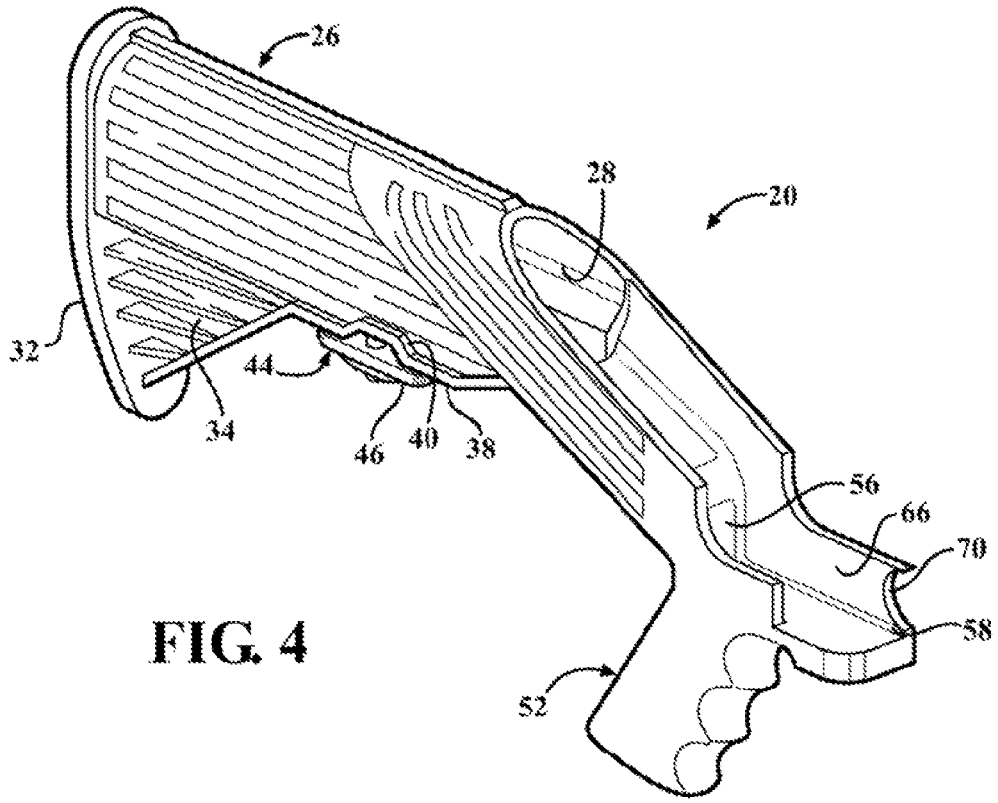
FIG. 4 is a perspective view of the first exemplary embodiment of the handle with the lock in a locked position.
Figure 5:
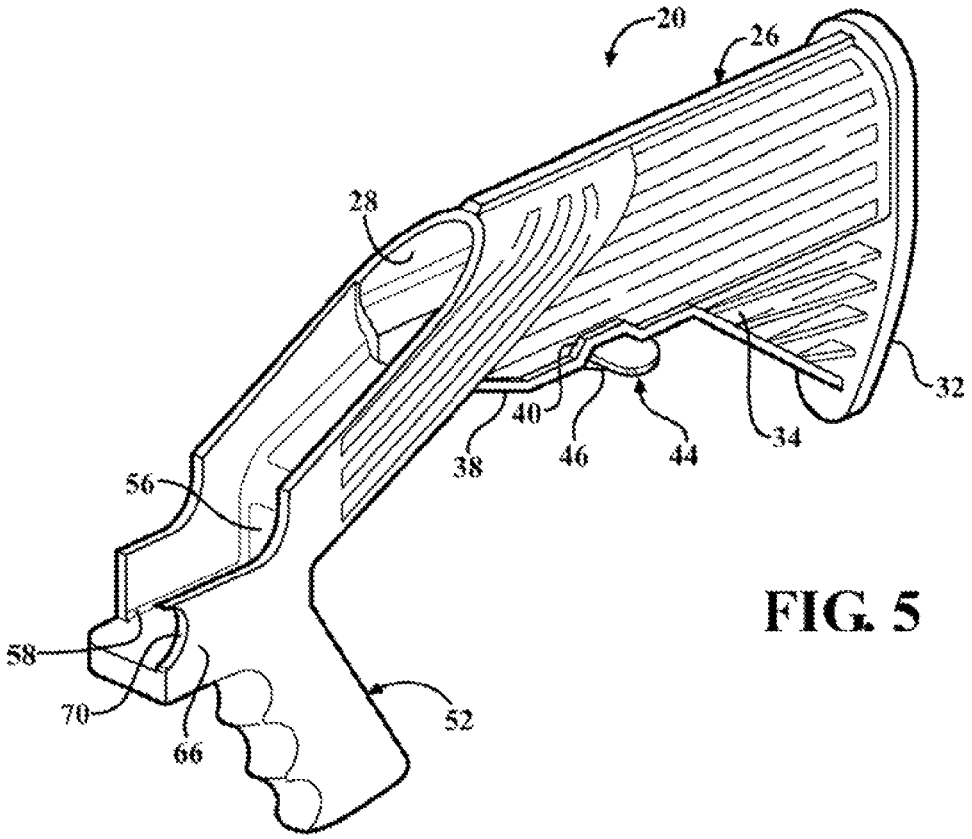
FIG. 5 is a perspective view of the first exemplary embodiment of the handle with the lock in an open position.

Referring to the Figures, wherein like numerals indicate like or corresponding parts throughout the several views, a serviceable firearm is shown comprising a handle 20 supported in a firing unit 22. The firing unit 22 includes a receiver 21 for chambering a round of ammunition, a barrel 23 extending forwardly from the receiver 21, and a trigger group 24 configured to selectively stimulate a round of ammunition disposed in the receiver 21. The firing unit 22 may also include additional features as will be readily understood by those of skill in the art and also as described in some details further below. The receiver 21 and barrel 23 and trigger 24 are moveable together as a firing unit 22. The handle 20 supports the firing unit 22 in use for aiming and shooting.

The handle 20 is shown in FIGS. 1-13 configured for attachment to an AR-15 type semi-automatic firing unit 22, as well as other firearm types model thereafter. For contrast, FIGS. 14A-19 show the handle 20' configured for attachment to an AK-47 type semi-automatic firing unit 22. For still further contrast, FIG. 20 shows the grip portion 152 of a handle configured for attachment to the firing unit (not shown) of a semi-automatic pistol. Gunsmiths and others of skill in this art will appreciate that, with minor modifications, the handle 20, 20' can be readily adapted to any suitable semi-automatic firing unit 22 such as the AR-10, SKS, FN-FAL, Mini 14, MAC-11, TEC-22, HK-91, HK-93, M1-A, K-1, K-2, and Ruger 10-22 devices to name but a few.

The invention will first be described in connection with the embodiment illustrated in FIGS. 1-13, namely configured for use with an AR-15 type rifle. According to one embodiment of this invention, the handle 20 includes a shoulder stock 26 configured to be pressed firmly into the shoulder of a user, as shown for example in FIG. 1. A buffer cavity 28 is formed inside the shoulder stock 26 for slidably receiving a buffer tube 30 of the semi-automatic firing unit 22. In the AR-15 implementation, the buffer tube 30 forms part of an interface system as will be described in greater detail below. Of course, the shape of the buffer cavity 28 could be modified or eliminated entirely to accommodate other types of semi-automatic firearms.

One end of the shoulder stock 26 of the handle 20 presents a butt end 32 for pressing into the shoulder of an operator when the firing unit 22 is raised to a firing position. The shoulder stock 26 may include ribs and webs 34 surrounding the buffer cavity 28 to establish a structurally supporting network. The shoulder stock 26 may take the form of a shell or monolithic structure. To a large extent, the aesthetic appearance of the shoulder stock 26 is subject to a wide range of expressions. A sling attachment slot 36 may be integrated into the shoulder stock 26 for attaching one end a sling (not shown). The other end of the sling may be attached to any suitable location including, for example, to a ring (not shown) disposed between the buffer tube 30 and the receiver 23 or a swivel clasp anchored adjacent the barrel 23.

The shoulder stock 26 includes an undersurface 38 which, in this particular example, extends forward from the butt end 32 toward the receiver 21. The undersurface 38 may be formed with a recessed portion 40. A bore 42 extends vertically from the recessed portion 40, through the vertical rib 34, and into the buffer cavity 28.

Figure 12:
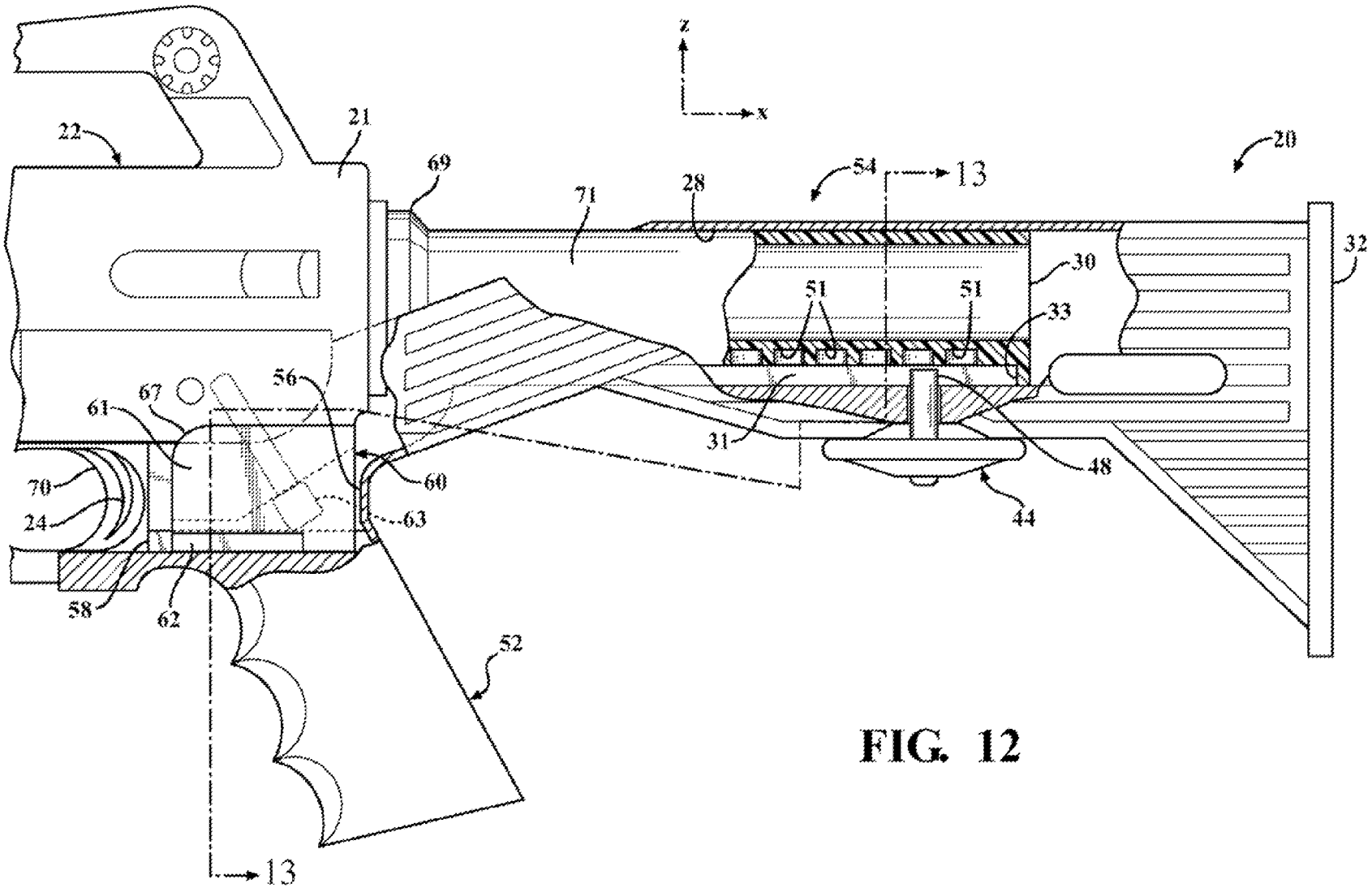
FIG. 12 is partial cross-sectional view through the handle showing the respective interactions of the first and second bearing elements in relation to the receiver portion of the firearm and with the lock feature according to one embodiment of the invention.
Figure 13:
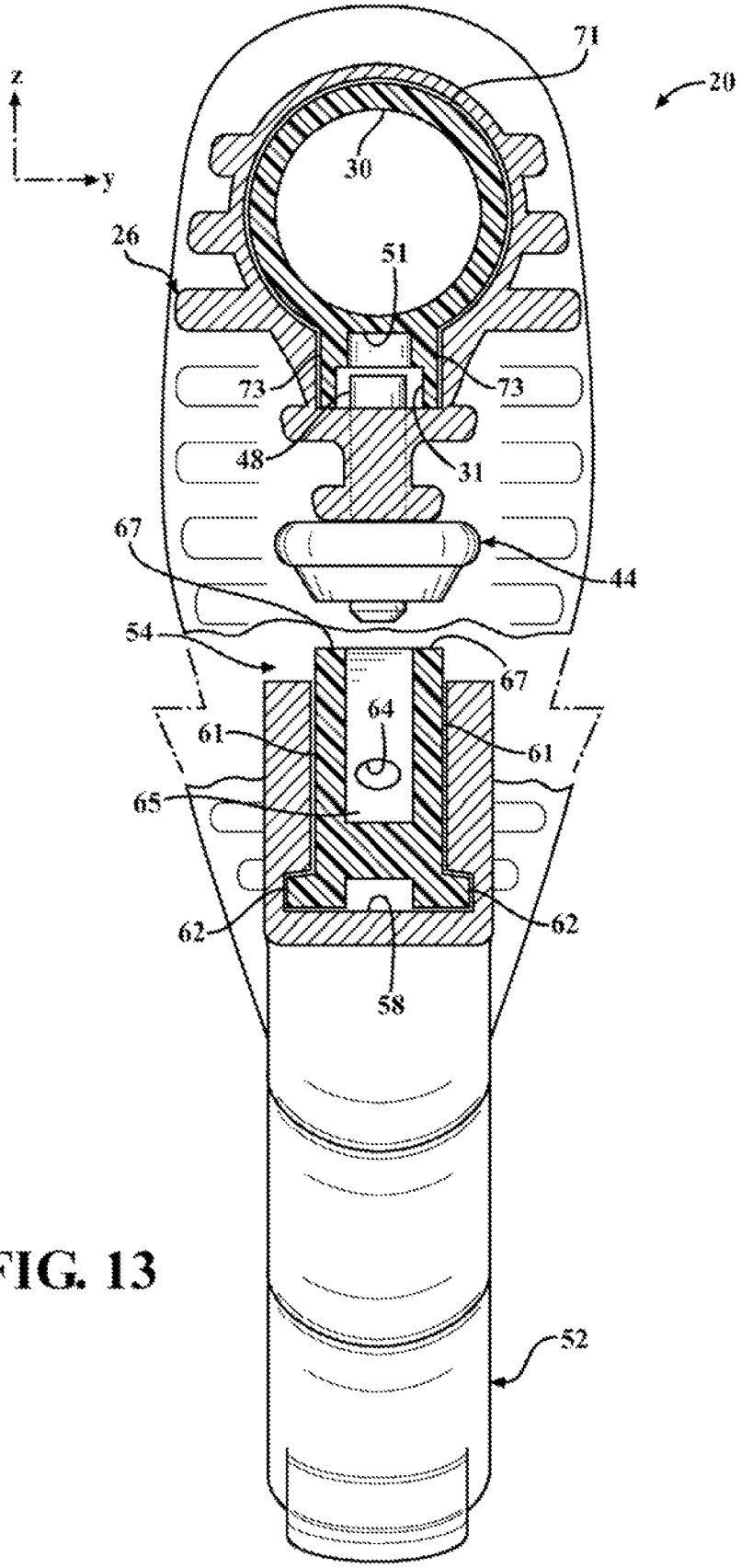
FIG. 13 is a cross-sectional view taken generally along lines 13-13 of FIG. 12 through the first and second bearing elements of the interface system according to one embodiment.

A lock 44 interacts with the recessed portion 40 and the bore 42 so as to allow a user to selectively switch operation of the firearm between traditional semi-automatic shooting modes and rapid firing modes, wherein rapid firing mode is accomplished using the novel methods of this invention. The lock 44 has an open position (shown in FIGS. 1-4, 10, 12 and 13) in which the firing unit 22 may operate in a rapid fire mode, and a locked position (FIG. 5) in which the firing unit 22 is constrained to traditional or standard fire of operation. In the open position, the lock 44 allows longitudinal movement of the firing unit 22 relative to the shoulder stock 26. The longitudinal direction is here defined as generally parallel to the long axis of the barrel 23, also referred to herein as the primary sliding axis. When the lock 44 is in the locked position (FIG. 5), the handle 20 is longitudinally locked to the firing unit 22 to prevent sliding movement of the firing unit 22 relative to the shoulder stock 26. In FIGS. 1 and 12, this primary sliding axis corresponds with the directional marker "x". If the barrel 23 of the firearm is held in a level shooting position as in FIG. 1, the x-axis lies in a horizontal plane. Other direction markers are also provided in correlation with the x-axis, namely a z-axis and a y-axis (FIGS. 1, 12 and 13). In the case of the barrel 23 held in a level shooting position, the z-axis will extended vertically, and the y-axis will extend perpendicularly from the x-axis but lie in the same horizontal plane.

Figure 7:
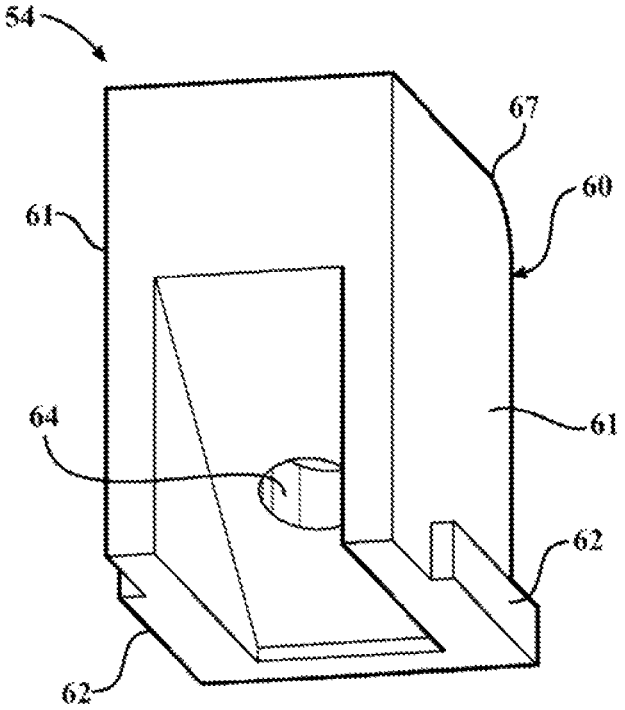
FIG. 7 is a rear perspective view of the first bearing element of FIG. 6.
Figure 8:
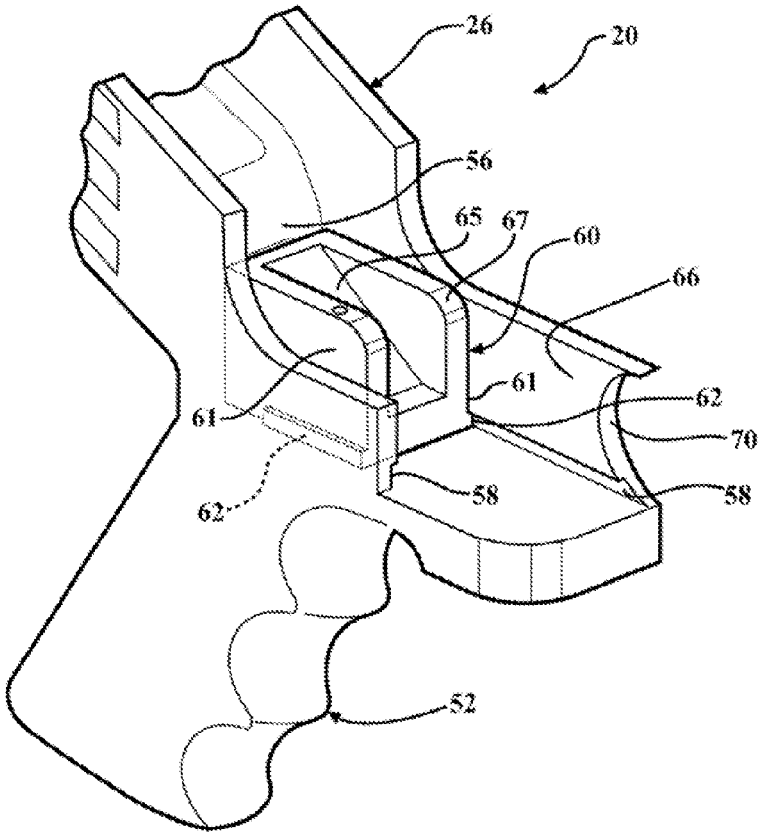
FIG. 8 is a perspective view of the first bearing element of FIG. 6 disposed for reciprocating movement within a fragmentary portion of the handle of FIG. 4.

The lock 44 of the first exemplary embodiment includes a cam 46 with a pin 48 extending perpendicularly away from the cam 46 into the bore 42 of the shoulder stock 26. As best shown in FIG. 7, the lock 44 may include a spring 50 for biasing the cam 46 against the undersurface 38 of the shoulder stock 26. The pin 48 and the spring 50 are preferably made of metal, but other materials may also be used. Of course, the lock 44 may be redesigned to mount and/or actuate in alternative ways. In the open position, the cam 46 extends parallel to the undersurface 38 and covers the recessed portion 40 of the undersurface 38 to vertically space the pin 48 from the buffer tube 30 of the firing unit 22. In other words, the cam 46 is turned such that interaction with the undersurface 38 forces a gap between the cam 46 and the recessed portion 40 of the undersurface 38. In the locked position, the cam 46 is turned perpendicularly relative to the undersurface 38, and the cam 46 is nestled into the recessed portion 40. This, in turn, causes the pin 48 to move vertically upwardly to engage a hole or detent 51 in the buffer tube 30 of the firing unit 22 and thereby prevent longitudinal movement of the firing unit 22 relative to the handle 20. It will be understood by those of skill in the art that buffer tubes 30 for military spec. AR-15 type rifles commonly include a row of holes or detents 51 for aligning with the length of the shoulder stock portion of a prior art firing unit. In typical AR-15 firearms, the bottom length of the buffer tube 30 is formed with a track 31 extending parallel to the primary sliding axis (x) and encircling the detents 51.

In this manner, the lock 44 is manipulatable to selectively engage the buffer tube 30. As mentioned previously and described more fully below, the buffer tube 30 functions also in this embodiment as part of an interface system and more specifically still a second bearing element of the interface system. The track 31 terminates at a rear stop 33, perhaps best shown in FIG. 12. The tip of the retractable pin 48 is thus, in use, disposed in the track 31 and engages the rear stop 33 to limit over-travel of the handle 20. That is, the handle 20 is prevented from inadvertently being pulled off the buffer tube 30 due to the interference created by the rear stop 33 in the traveling path of the tip of the pin 48. During rapid fire mode, the tip of the pin 48 slides back and forth in the track 31. However, in single-fire mode, the tip of the retractable pin 48 is selectively inserted into one of the detents 51 to arrest movement of buffer tube 30 relative to the lock 44. The lock 44 thus provides the operator with an extremely simple and quick way to switch between the rapid fire mode and the standard fire mode. Naturally, the particular design of the lock 44 illustrated in FIGS. 1-13 is but one of many possible expressions with which to accomplish the lock-out function. Indeed, other rifle types may require some other strategy by which to mount the lock 44 so that a user can selectively switch operation of the firearm between traditional semi-automatic shooting mode and rapid firing mode.

When the lock 44 is in the locked position with the pin 48 engaging the detent 51 or hole in the buffer tube 30, the buffer tube 30 is locked relative to the buffer cavity 28 and the firing unit 22 cannot slide in the handle 20. However, when the lock 44 is in the open position, the buffer tube 30 is free to slide in the buffer cavity 28 and thus the handle 20 relative to the firing unit 22.

The first exemplary embodiment of the handle 20 further includes a hand grip portion, generally indicated 52, connected to the shoulder stock 26. The grip portion 52 extends downwardly and slightly angularly rearwardly in an ergonomically suitable position common with many military and sporting rifle designs. It should be appreciated that the grip portion 52 of the handle 20 could take many different forms. For example, in an alternative embodiment, the grip portion 52 could take the shape of the neck-like region of the shoulder stock 26 just behind the trigger 24 of the firing unit 22, as is typical in many hunting rifles.

An interface system 54 is provided for slidably connecting the sliding handle 20 to the firing unit 22. The interface system 54 is attached so that it moves longitudinally back and forth with the firing unit 22 in the handle 20 when using the device in rapid fire mode. A main objective of the interface system 54 is to provide a secure and stable sliding joint between the firing unit 22 and the handle 20 than functions to establish a constrained linear path P generally parallel to the firearm barrel 23 and parallel to the above-mentioned primary sliding axis (x). In other words, the interface system 54 is adapted to be placed in direct sliding contact with the sliding handle 20 for relative movement along the primary sliding axis x.

In one embodiment designed specifically for AR-15 rifles and other firearms of similar enough design, the interface system 54 includes a first bearing element 60 that may take the form of a block-like member as shown in FIGS. 6-9 and 12-13, the first bearing element 60 establishes at least one, but preferably several, first sliding surfaces configured to, in use, extend generally parallel to the barrel 23 of the firing unit 22. The first sliding surface includes a pair of side walls 61 spaced apart from one another. The side walls 61 are preferably parallel to one another and lie in planes parallel to the z-axis, however other designs and arrangements may be pursued in which the side walls 61 are cylindrical, oblique, or otherwise shaped while still enabling relative movement with respect to the handle 20 along the primary sliding axis x. The first sliding surface may also include a pair of flanges 62 extending outwardly from the side walls 61. The side walls 61 in combination with the optional flanges 62 are adapted to operatively engage an inverted T-slot formation 58 in the sliding handle 20. This T-slot formation 58 is perhaps best shown in the cross-sectional view of FIG. 13. The inverted "T" shaped channel having an open front and a closed back 56 with a pair of opposing grooves 58, in combination with the buffer cavity 28, forms the opposing surfaces against which the first 60 and second 30 bearing elements slide. The first bearing element 60 is thus slidably disposed in the inverted "T" shaped channel 58. The opposing flanges 62 register in the grooves 58 of the "T" shaped channel to constrain the movement of the firing unit 22 within the handle 20 to linear motion only along the path P. Although the T-slot 58 configuration is presented here in the context of a best mode, it will be understood that the interface system 54 may be shaped and designed very differently while still providing substantially equivalent functionality.

Figure 9:
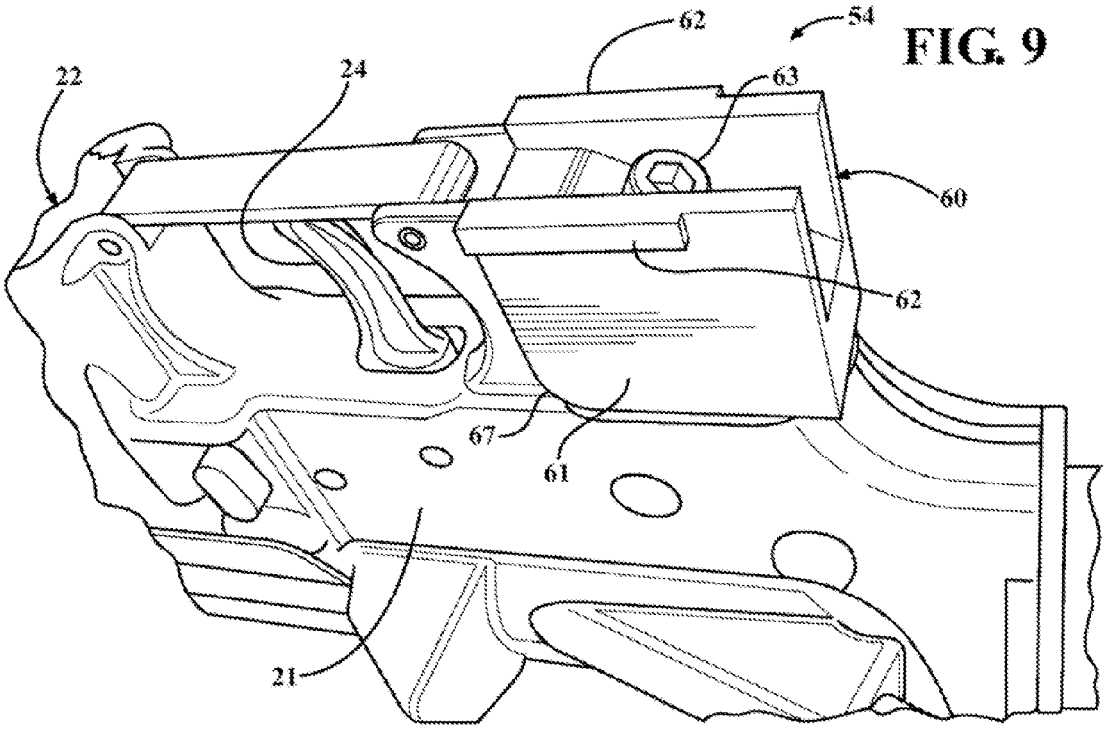
FIG. 9 is an inverted view of the receiver portion of an AR-15 style semi-automatic firearm shown the first bearing element engaged thereto with a mated fit directly behind the trigger.

For the AR-15 model, the first bearing element 60 is affixed behind the trigger 24 assembly of the firing unit 22 in the location, and using the same anchoring socket, that previously secured the Original Equipment pistol grip. To accomplish this attachment, the first bearing element 60 includes a first mounting feature adapted for fixed attachment to the firing unit 22. The first mounting feature includes a first fastener 63 as shown in FIGS. 9 and 12. The first fastener 63 is preferably a threaded bolt or machine screw that extends between the side walls 61 for securely attaching to the receiver portion 21 of the firing unit 22. The first mounting feature also includes a receiver engaging profile adapted to engage the receiver 22 with a mated fit directly behind the trigger 24. The receiver engaging profile includes a sloping surface 65 oriented obliquely relative to said primary sliding axis x. The receiver engaging profile also includes a pair of ears 67 extending on opposite sides of the sloping surface 65. A hole 86 may be provided on the top of one ear 67 to accept the OE safety spring. These features of the receiver engaging profile are perhaps best shown in FIGS. 6 and 8. A mounting hole 64 is formed through the sloping surface 65 for receiving the first fastener 63. In other design variations, the attachment points and methods may be different.

While it would be possible to accomplish the purpose of the interface system 54 with only the first bearing element 60, in several embodiments the interface system 54 includes also a second bearing element 30. In the embodiment of FIGS. 1-13, the first 60 and second 30 bearing elements are disjointed from one another and adapted only in use to be interconnected to one another through the firing unit 22. Through economy of design, this embodiment thus utilizes the OE buffer tube 30 as part of the sliding interface system 54, to provide a concerted constraining effect on the movement of the firing unit 22 within the handle 20 so that relative linear motion therebetween occurs only along the path P. The second bearing element 30 is provided with a second mounting feature 69 adapted for fixed attachment to the firing unit 22. The first mounting feature 63 is spaced from the second mounting feature 69 to emphasize that they are distinct mounting features, independent of one another, and located far enough apart to improve structural performance of the overall assembly. In the AR-15 example where the buffer tube 30 is re-purposed as the second bearing element 30, the second mounting feature 69 becomes the threaded coupling system used to connect the buffer tube 30 to the receiver 21.

Functionally, the second bearing element 30 may be considered similar in many ways to the first bearing element 60. The second bearing element 30 includes a second sliding surface, which like the first, is also configured to, in use, extend generally parallel to the barrel 23. And likewise also the second sliding surface is adapted to be placed in direct sliding contact with the handle 20 for relative movement therebetween along the primary sliding axis x. The second sliding surface is shown here including at least one curved section 71 comprising the generally cylindrical outer surface of the buffer tube 30. The second sliding surface includes also at least one planar surface 73 in combination with the at least one curved section 71. The planar surface 73 is perhaps best shown in FIG. 13 as being formed by the outer sides of the track 31. The buffer cavity 28 formed in the shoulder stock 26 has a mating shape that slides in surface-to-surface contact with the second sliding surfaces 71, 73 of the buffer tube/second bearing element 30. As can be seen clearly in FIG. 13, the second sliding surfaces 71, 73 have a different geometric cross-section from the geometric cross-section of said first sliding surfaces 61, 62. This divergent cross-sectional shapes allow the design of each element to be optimized so as to minimize binding and allow efficient manufacturing techniques.

Stability and durability are earnestly desired attributes of the subject handle 20, especially during cyclic reciprocating longitudinal movement during the rapid-firing mode of operation. In order to further these objectives, the second sliding surface 71, 73 may be spaced laterally (relative to said primary sliding axis x) from said first sliding surface 61, 62. The lateral spacing is most preferably accomplished along the z-axis, but could in some contemplated embodiments be accomplished in the y-direction. Still further toward improving sliding stability and durability, the entirety of the first sliding surfaces 61, 62 may be spaced longitudinally (relative to said primary sliding axis x) from the entirety of the second sliding surface. This longitudinal spacing, i.e., offset in the direction of the constrained linear path P, is perhaps best shown in FIG. 12, and provides forward and rearward bearing points to help resist racking during rapid-fire operation.

The handle 20 further includes a trigger guard 66 extending longitudinally forward from the grip portion 52 for disposition on one side of the trigger 24 of the firing unit 22. The trigger guard 66 extends longitudinally forward of the trigger 24 to an open end that forms a finger rest 70 for stabilizing an actuator 74, such as a finger or other stationary object. The actuator 74 is the element used to make direct contact with the trigger 24. Alternatively to the operator's finger, a cross-pin or any other comparable object could be used as the actuator 74 and placed at or near the finger rest 70 in a position to intermittently make contact with the trigger 24. Thus, for handicapped users without the use of a suitable trigger finger, a cross pin affixed at or near the rest 70 may serve as the actuator 74 instead of a human finger. When the actuator 74 is stabilized with respect to the rest 70, the trigger 24 will intermittently collide with the actuator 74 in response to linear reciprocating movement of the firing unit 22, and in particular after the firing unit 22 has been moved longitudinally forward by a predetermined distance D relative to the handle 20. The predetermined distance D is at least equal to, but more preferably greater than, the separation distance between actuator 74 and trigger 24 that is needed to fully reset the trigger 24 so that the firing unit 22 can be fired again. This trigger 24 resting phenomenon is a function of the mechanical design of the trigger group assembly, the springs used therein, parts wear, lubrication qualities, etc. In most cases, the distance D may be established at about one inch (1") of travel. The relative sliding distance between the bearing element 60 and the interface system 54 is thus generally equal to the predetermined distance D, which in turn may be several times longer than the actual minimum separation distance needed to rest the trigger 24. In this way, the trigger 24 is reasonably assured to rest at some point while the firing unit 22 separates from the handle 20 along the travel distance D.

The trigger guard 66 may be disposed on both sides of the trigger 24 providing something resembling a stall or chute for the trigger 24 to slide back and forth in. However, for ease of access the trigger guard 66 may be shortened on one side so that the trigger 24 can be accessed on the side of the firing unit 22 for firing the firing unit 22 in the standard firing mode, as will be discussed in greater detail below. In this manner, the trigger guard 66 restricts or otherwise impedes access to the trigger 24, but in the preferred embodiment does not prevent access altogether. That is to say, the shooter can choose to remove their finger from the rest 70 and access the trigger 24 in the traditional manner, preferably in conjunction with locking out the sliding functionality via the lock 44. The shoulder stock 26, grip portion 52, and trigger guard 66 are preferably made as a monolithic unit of a glass filled nylon, a polymer filled nylon, carbon fiber, metal, or any other material strong enough to withstand repeated discharges of the gun over time. Injection molding is the preferred manufacturing process of the handle 20, but casting, machining, or any other manufacturing process may also be employed depending, at least in part, on the specific material used.

Installation of the first exemplary embodiment of the handle 20 is very simple. On AR based rifles, like the one shown in FIGS. 1-3 and 12, the manufacturer's shoulder stock is first removed from the buffer tube 30. Next, the manufacturer's pistol grip is removed using an Allen wrench or other suitable tool. The first bearing element 60 is then mounted onto the firing unit 22 where the pistol grip was previously mounted with the first fastener 63 or any other suitable fastener placed through the aperture 64. Of course, the shape of the first bearing element 60 may take many different forms and its particular mounting arrangement altered to suit different types of firing units 22. The first bearing element 60 may even be selected from some pre-existing portion, i.e., a factory installed feature, of the firing unit 22 and re-purposed for use after the example set by the re-purposing of the buffer tube 30. Once the first bearing element 60 has been mounted onto the firing unit 22, the buffer tube 30 of the firing unit 22 is slid into the buffer cavity 28 of the shoulder stock 26 of the handle 20. Simultaneously, the ridges 62 of the first bearing element 60 are guided into the grooves 58 in the T-slot 58 to slidably support the firing unit 22 within the handle 20. The lock 44 may now be rotated to the position shown in FIG. 4 to put the firing unit 22 in the standard fire mode or the lock 44 to the position shown in FIG. 5 to put the firing unit 22 in the rapid fire mode.

Figure 14A:
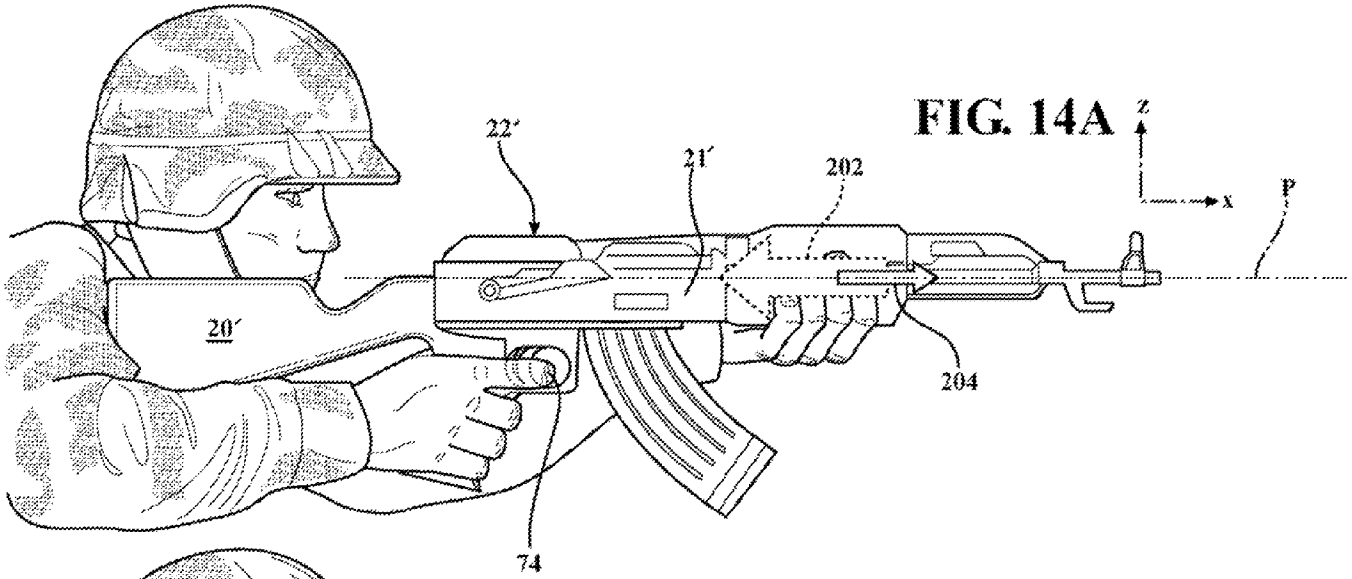
FIGS. 14A and 14B show time sequence views of a user holding a firing unit that is slidably supported in a handle according to another embodiment of this invention, the firing unit shown in a rearward configuration in FIG. 14A allowing the trigger to reset and in a forward configuration in FIG. 14B in which a round of ammunition is discharged according to the firing method of this invention.
Figure 14B:
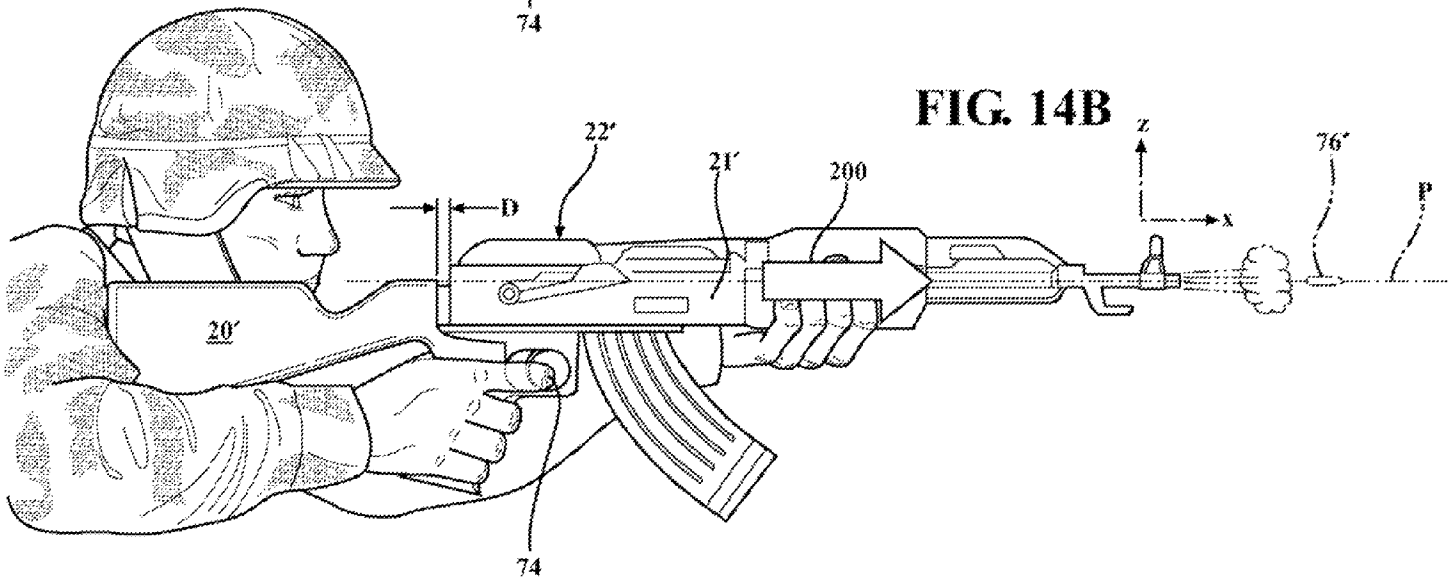
Figure 15:
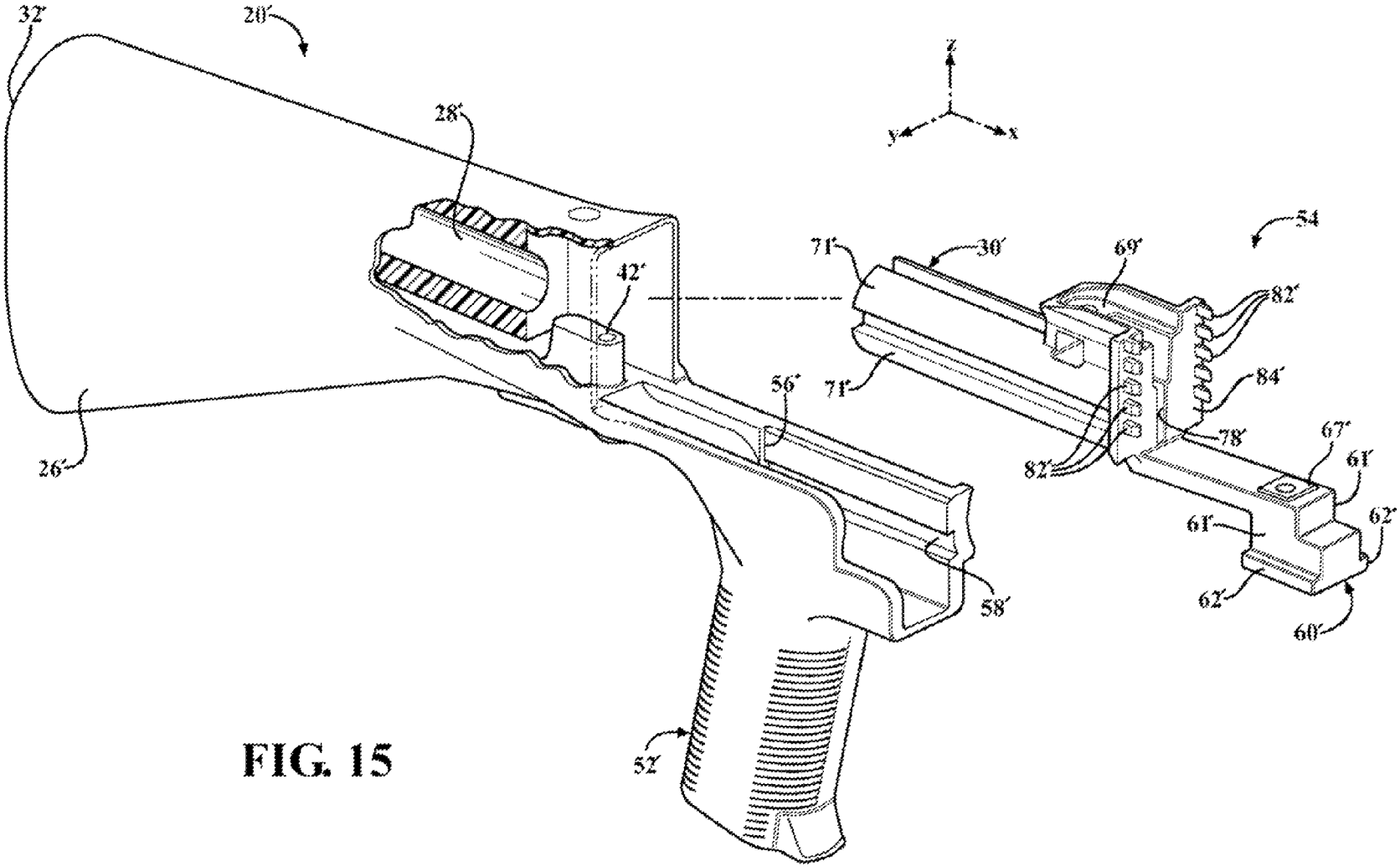
FIG. 15 is a perspective view of the handle for the embodiment shown in FIGS. 14A-B together with an interface system exploded therefrom to depict the first and second bearing elements.

Although the first embodiment of the handle 20 is shown mated with an AR-15 firing unit 22, it must be appreciated that with minor geometrical changes, the handle 20 may be mounted to other types of semi-automatic firing units, including both rifles and pistols. For example, FIGS. 14A-19 illustrate application of the concepts of this invention to an AK-47 type firearm. For convenience, like or corresponding features to the embodiment of FIGS. 1-13 are reused with respect to FIGS. 14A-19 with the addition of prime designations. A handle 20' is shown in FIG. 15 including a shoulder stock 26' and pistol grip 52' functionally equivalent to the preceding example. A buffer cavity 28' is formed inside the shoulder stock 26'. An inverted T-slot 58' is also formed in the handle 20'. In this example, the interface system 54' is modified to include first 60' and second 30' bearing elements that are directly interconnected to one another as a monolithic structure. Despite the monolithic construction, the first sliding surface includes a pair of side walls 61' spaced apart from one another. The side walls 61' are preferably parallel to one another and lie in planes parallel to the z-axis, however other designs and arrangements are possible. The first sliding surface also includes a pair of flanges 62' extending outwardly from the side walls 61'. The side walls 61' in combination with the optional flanges 62' operatively engage the inverted T-slot formation 58' in the sliding handle 20'.

Figure 16:
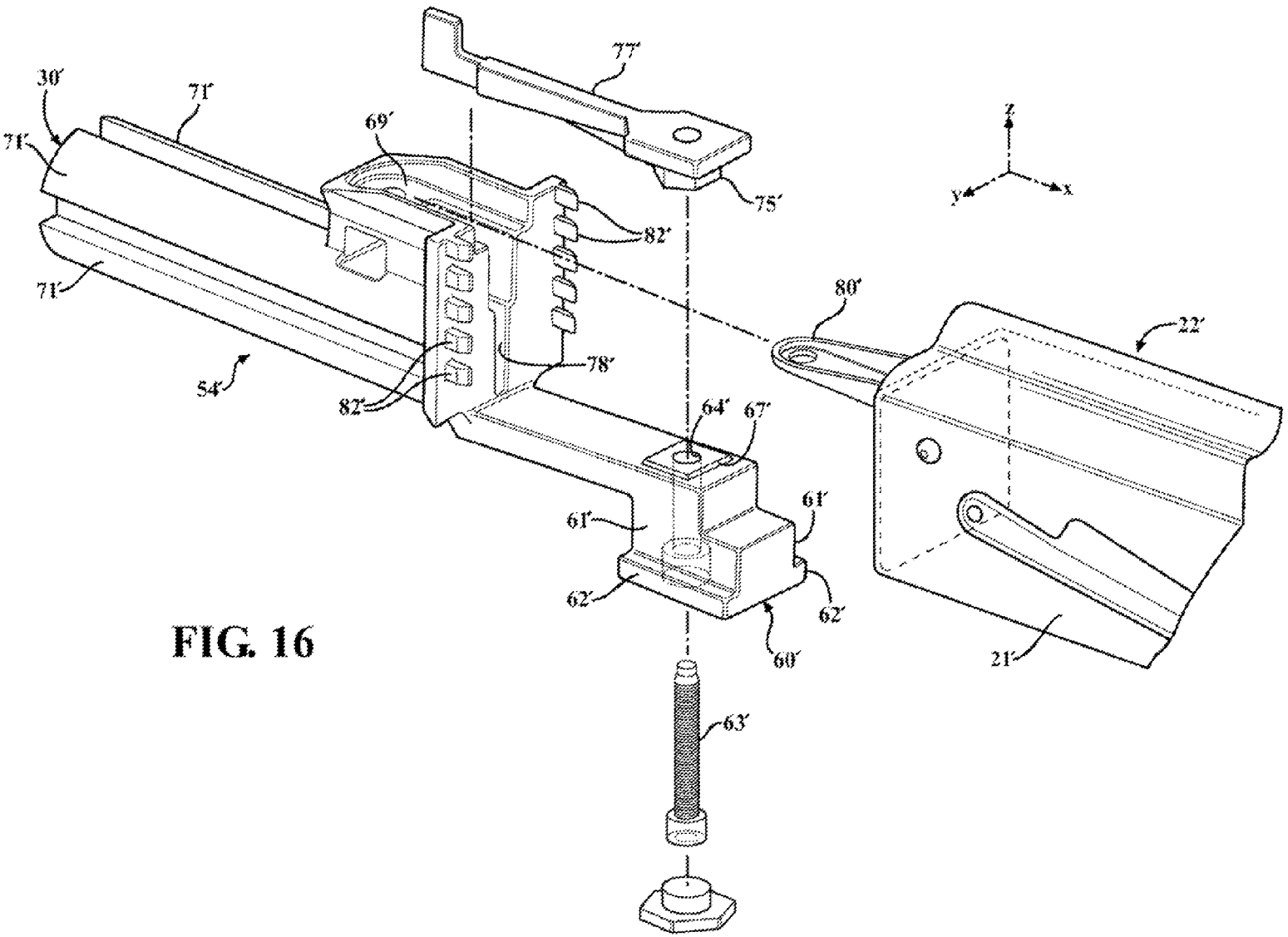
FIG. 16 is a perspective view of the interface system of FIG. 15 showing a captured nut element thereof exploded away together with a fragmentary port of a receiver of an AK-47 style firearm.

As in the AR-15 model, the first bearing element 60' in this AK-47 version is also preferably affixed behind the trigger assembly of the firing unit 22' using available anchoring structure. To accomplish this attachment, the first bearing element 60' includes a first mounting feature adapted for Fixed attachment to the firing unit 22'. The first mounting feature includes a first fastener 63' as shown in FIG. 16. The first fastener 63' is preferably a threaded bolt or machine screw that extends between the side walls 61' for securely attaching to the receiver portion 21' of the firing unit 22'. The first mounting feature also includes a receiver engaging profile adapted to engage the receiver 22' with a mated fit directly behind the trigger. The receiver engaging profile in this example is adapted to the available structure and includes a stub tenon 67'. The stub tenon 67' is non-circular, more particular square, to fit in a complimentary shaped square opening common in the bottom sheet metal structure of AK-47 type receivers 21'. A mounting hole 64' is formed through the first bearing element 60' for receiving the first fastener 63'. In other design variations, the attachment points and methods may be different.

FIGS. 16 and 18 show the first mounting feature including a captured nut 75' generally aligned with the mounting hole 64'. Unlike the tapped hole available on AR-15 style rifles, a supplemental nut 75' must be provided in the AK-47 to receive the threaded of the first fastener 63'. Positioning the captured nut 75' directly over the mounting hole 64' is made convenient by supporting the captured nut inside the receiver 21' on a connector arm 77'. The far tip of the connector arm 77' is wedged or clipped into a slot 78' formed in the interface system 54'. As a result, the connector arm 77' is removably connected to the first sliding surface. This facilitates manufacturability of the interface system 54', and can be accomplished by alternate methods.

While it would be possible to accomplish the purpose of the interface system 54' with only the first bearing element 60', here also the interface system 54' includes a second bearing element 30'. The second bearing element 30' is provided with a second mounting feature 69' adapted for fixed attachment to a convenient mounting bracket 80' of the firing unit 22'. As shown in FIGS. 16-18, this may include a screw and nut combination. Here again, the first mounting feature 63' is spaced from the second mounting feature 69' to achieve similar benefits.

The second bearing element 30' includes a second sliding surface adapted to be placed in direct sliding contact with the handle 20' for reciprocating movement along the primary sliding axis x. The second sliding surface is shown in FIGS. 15-17 including at least one curved section 71' comprising four sectors of a generally cylindrical outer surface. The second sliding surface includes also at least one planar surface 73' in combination with the at least one curved section 71'. The planar surface 73' is perhaps best shown in the cross-sectional view of FIG. 18. The buffer cavity 28' formed in the shoulder stock 26' has a mating shape that slides in surface-to-surface contact with the second sliding surfaces 71', 73' of the second bearing element 30'. As in the preceding example, the second sliding surfaces 71', 73' are illustrated having different geometric cross-sections, but it should be understood that identical cross-sectional shaped could be utilized without departing from the spirit of scope of this invention.

As in the preceding example, stability and durability are similarly earnestly desired attributes of the subject handle 20'. Therefore, the second sliding surface 71', 73' may be spaced laterally from said first sliding surface 61', 62'. The lateral spacing is accomplished along the z-axis again in this example, but could alternatively be accomplished in the y-direction. And also, the entirety of the first sliding surfaces 61', 62' may be spaced longitudinally from the entirety of the second sliding surface to provide forward and rearward bearing points that help resist racking during operation.

The interface system 54' further includes a third mounting feature 82' adapted for fixed attachment to the firing unit 22'. The third mounting feature 82' is spaced from the first mounting feature 63' and also from the second mounting feature 69' thus adding even further strength to the assembly. The third mounting feature 82' again takes advantage of available structure with a plurality of friction fit connection arranged about the perimeter of a cover 84'. When the interface system 54' is mounted to the firing unit 22', as shown for example in FIGS. 17-9, the cover plate 84' seals the otherwise open end of the receiver 22'. It will be appreciated that the interface system 54, 54' of this invention is intended to be a flexible mounting system that can be adapted to any firearm type using one (first 60, 60'), two (second 30, 30') or more bearing elements and one (first 63, 63'), two (second 69, 69'), three (third 78') or more mounting features.

Figure 19:
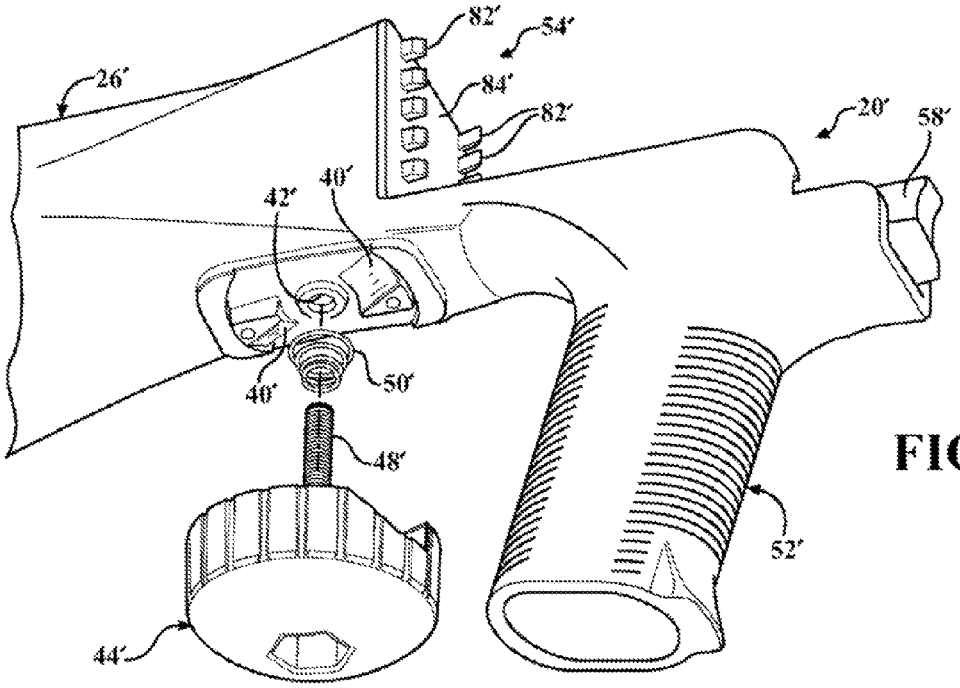
FIG. 19 is a perspective view of the handle of FIG. 15 showing the lock features exploded away.
Figure 20:
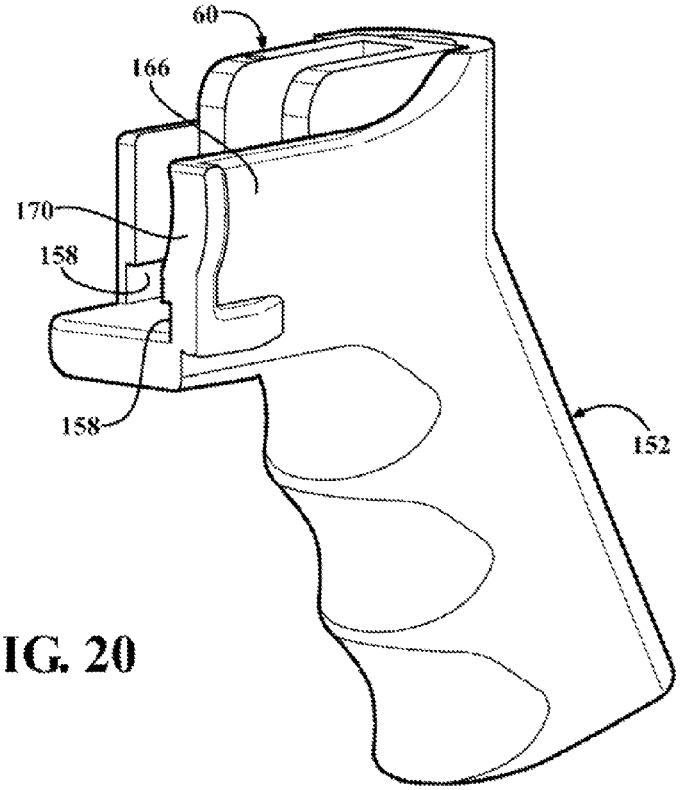
FIG. 20 is a perspective view of an alternative embodiment of the handle adapted for use with a pistol-style firing unit (as distinguished from a rifle-style firing unit) and showing the first bearing element of FIG. 6 disposed for reciprocating movement therein.

The lock 44' is best shown in FIGS. 18-19 and operates in a generally similar manner to that of the preceding embodiment shown in FIGS. 1-13 with open and closed positions yielding similar functionality. The lock 44' includes a cam 46' with a pin 48' extending into the buffer cavity 28'. The tip of the pin 48' rides in a track 31' in the bottom of the second bearing element 30' that extends parallel to the primary sliding axis (x). A single detent 51' is provided inside the track 31'. A rearstop 33' at the end of the track 31' limits over-travel of the handle 20'. During rapid fire mode, the tip of the pin 48' slides back and forth in the track 31'. However, in single-fire mode, the tip of the retractable pin 48' is selectively inserted into the one detent 51'.

Figure 6:
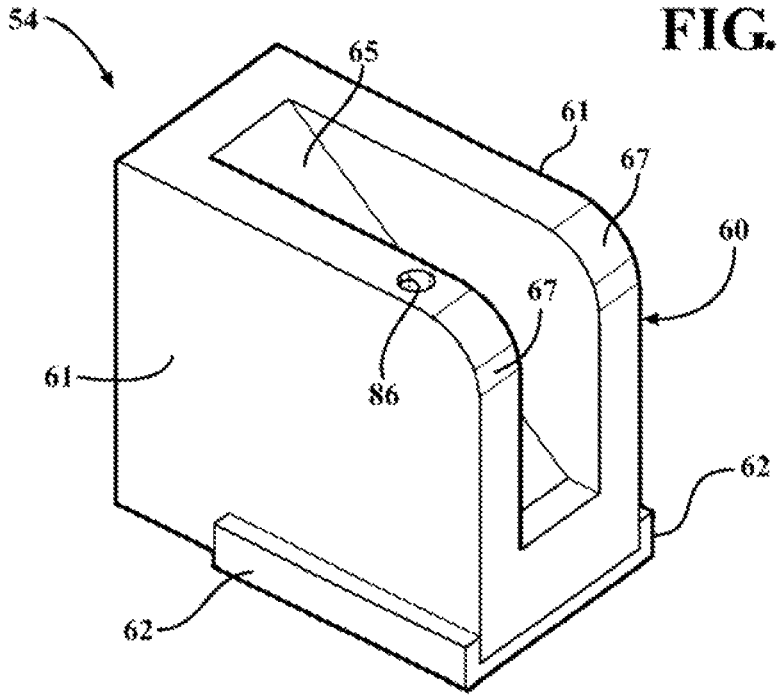
FIG. 6 is a front perspective view of the first bearing element according to one embodiment of the invention.

FIG. 20 shows a still further embodiment of the handle 120 for use in this case with a semi-automatic hand gun (not shown). The interface system here is composed of the first bearing element 60 substantially as shown in FIGS. 6-7. This embodiment lacks the shoulder stock portion of the first embodiment but includes a grip portion 152 defining a T-slot channel 158. The first bearing element 60 is slidably disposed in the channel 158. A trigger guard 166 is disposed longitudinally forward of the trigger (not shown) of the hand gun. The trigger guard 166 also includes a finger rest 170 for holding a finger or other actuator (not shown) in a generally stationary position. This embodiment may also include a lock so that it can function in either a rapid fire mode or a standard fire mode. As expressly stated above, the interface system of this invention is intended to be a flexible mounting system that can be adapted to any firearm, including both rifles and pistols, using one or more bearing elements and one or more mounting features.

Figure 21:
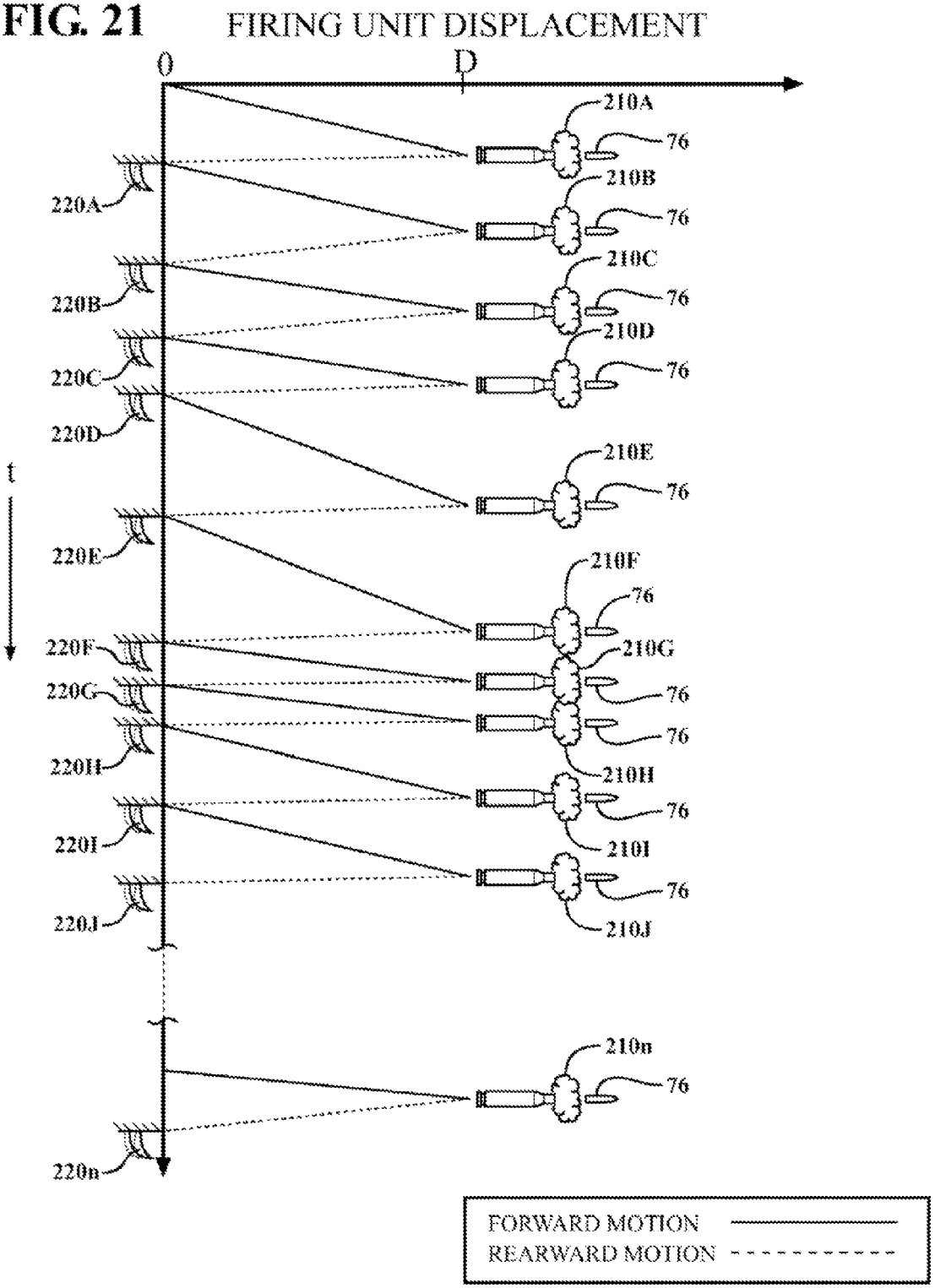
FIG. 21 is a simplified diagram charting displacement of the firing unit (relative to the handle) versus time to show the relationship between forward and rearward movement of the firing unit to trigger resetting and ammunition discharge, with the firing tempo being varied by changes in the user's muscle power.
Figure 22:
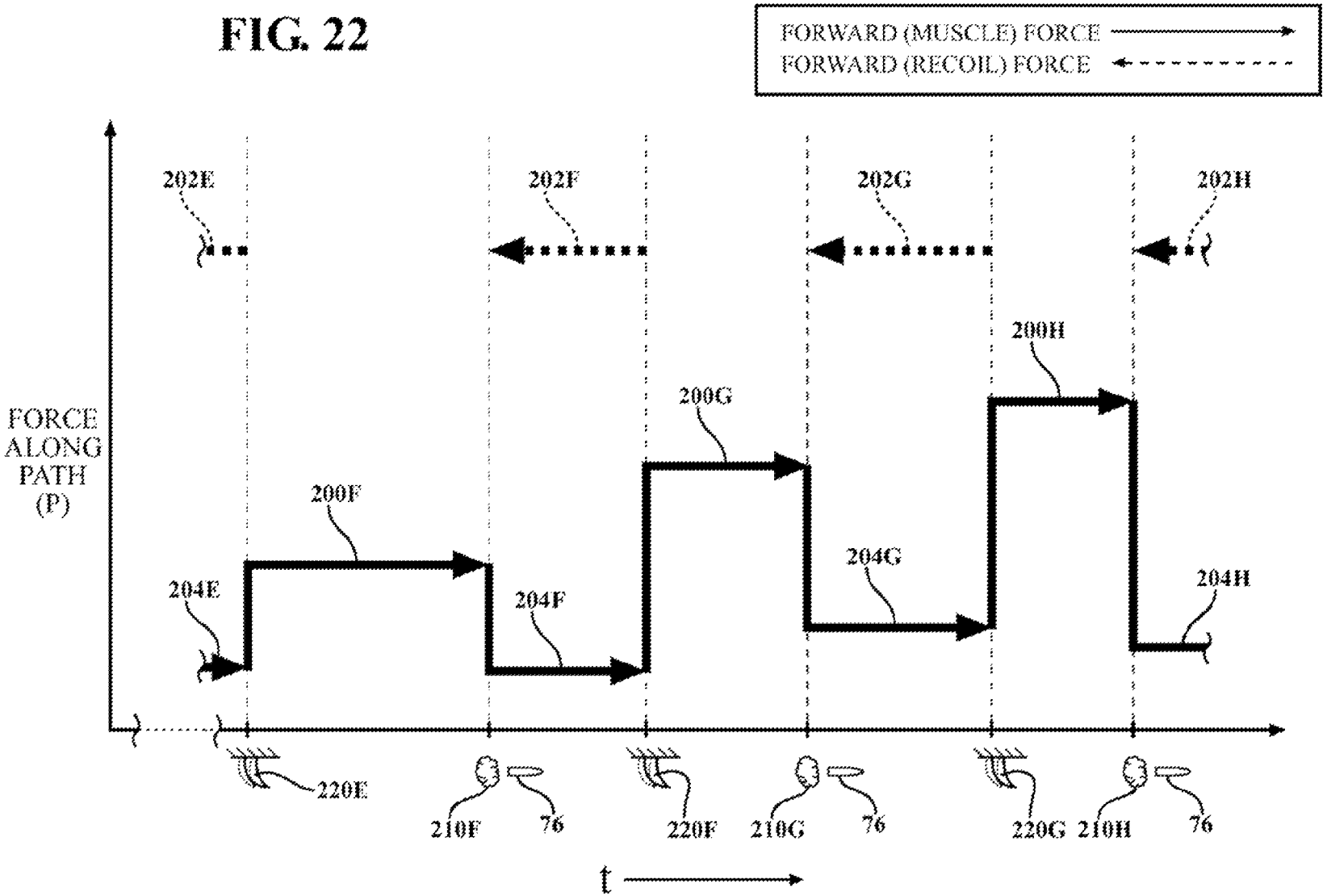
FIG. 22 is a simplified diagram charting force along the constrained linear path (P) versus time to illustrate the relationship between changes in forward muscle force and corresponding changes in the firing tempo of the firearm.
Figure 23:
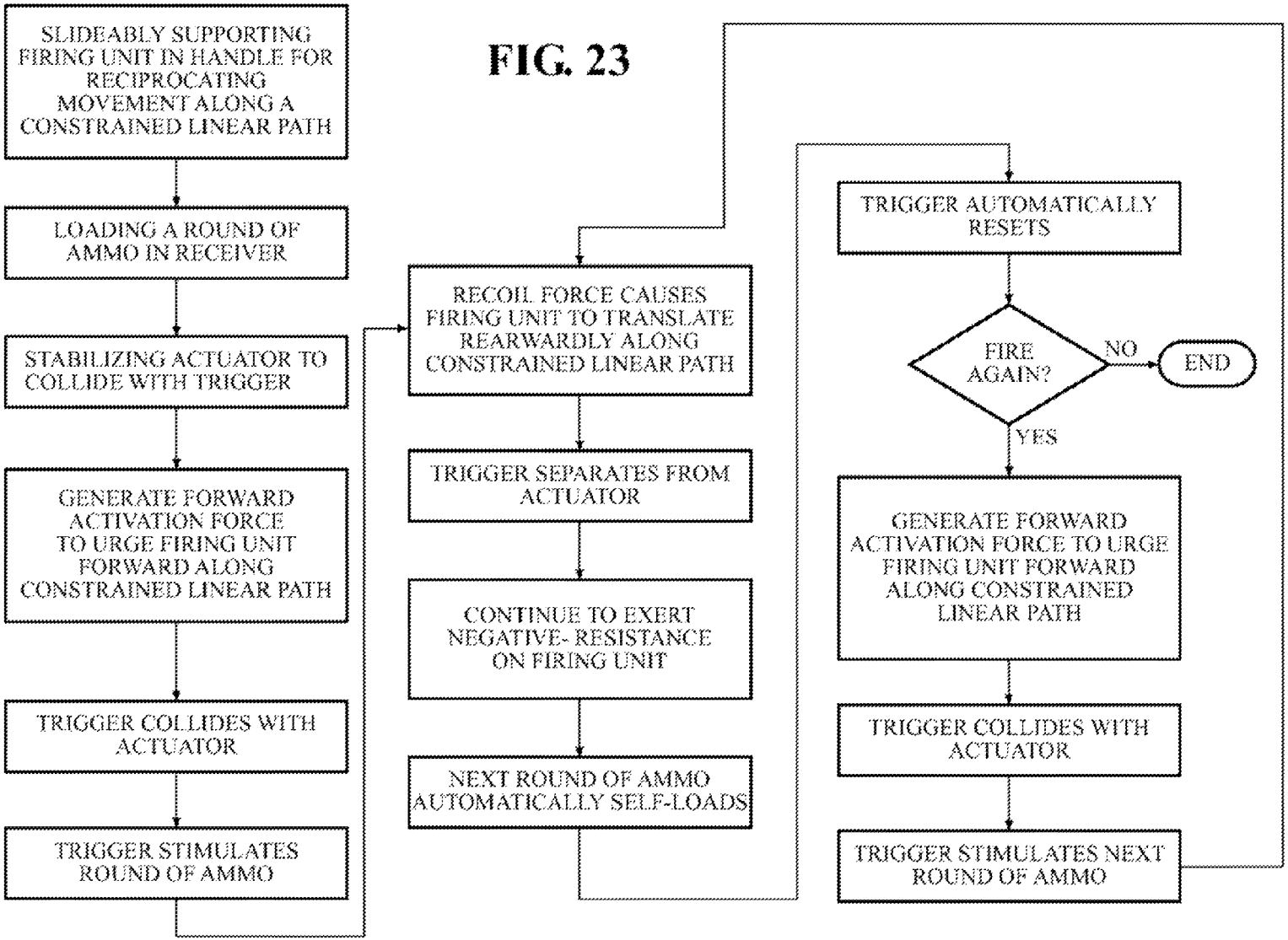
FIG. 23 is a simplified flow diagram illustrating steps in the firing method according to one embodiment of this invention.

Turning now to FIGS. 21-23, a method for firing multiple rounds of ammunition in succession from a semi-automatic firearm according to the novel shooting methods of this invention will be described in greater detail. A human user is provided having first and second body parts. For most users, the first and second body parts will comprise left and right hands. However, the shooting method can be adapted for use in non-standard ways that may require the first and second body parts to be identified as other parts of the human body. In any event, it is intended that the first body part is moveable relative to the second body part, and that the user is capable of creating controlled muscle forces in response to movement of the first body part. That is, the user is in control of their first body part (e.g., left hand) to a degree required for safe operation of a firearm.

Once a first round of ammunition is loaded into the receiver 21, the user's first body part (e.g., left hand) is placed in operative relationship with the firing unit 22 (e.g., gripping a hand guard 72 under the barrel 23) so that movement of the first body part causes a corresponding movement in the firing unit 22. The actuator 74 (e.g., a right hand index finger) is then stabilized in a stationary position relative to the user's second body part (e.g., right hand) so that the firearm trigger 24 will intermittently collide with the actuator 74 in response to linear reciprocating movement of the firing unit 22. Next, the user's first body part (e.g., left hand) is moved relative to the second body part (e.g., right hand) using human muscle power to generate a primary forward activation force 200 (see FIG. 14A) that urges the firing unit 22 forwardly so that the trigger 24 collides a first time with the stabilized actuator 74. Contact with the trigger 24 stimulates the first round of ammunition loaded in the receiver 21. That is to say, as a direct response to the step of moving the first body part relative to the second body part, the live round of ammunition is activated in the chamber of the receiver 21. Naturally, this stimulating step results in discharging at least a portion of the first round of ammunition (e.g., the bullet 76 or projectile portion of the ammunition round) from the receiver 21 into the barrel 23, typically leaving a spent shell casing in the receiver 21. A recoil force 202 (see FIG. 14B) is thus generated of sufficient strength to cause the firing unit 22 to translate rearwardly relative to the stabilized actuator 74. This has the immediate effect of separating the trigger 24 from the actuator 74. The total rearward distance the firing unit 22 may travel relative to the handle 20 is the predetermined distance D, and the recoil force 202 is so great that the short distance D is traversed in a small fraction of a second. At some point while the firing unit 22 is in rearward motion as a result of the recoil event, the spent shell casing of the first round is ejected and a second round of ammunition is automatically self-loaded into the receiver 21. This automated ejection and self-loading step is characteristic of a semi-automatic firearm, which typically exploits gas pressures scavenged from the expanding gunpowder of a discharging round of ammunition. After the firing unit 22 has traveled rearwardly relative to the handle 20 by the predetermined distance D, the user's first body part (e.g., left hand) is re-moved using human muscle power to generate a secondary forward activation force 200 that urges the firing unit 22 forwardly relative to the stabilized actuator 74 so that the trigger 24 collides a second time with the stabilized actuator 74. The stimulating step is then repeated with respect to the second round of ammunition in the receiver 21. The whole firing cycle described above can then be repeated for a third and following rounds in rapid succession, resulting in a unique and enjoyable shooting style where the user creates the forces 200, 204 that, acting in opposition to the recoil force 202, cause the firing unit 22 to shuttle quickly back-and-forth in the handle 20.

The method of this invention is distinguished from the relatively uncontrollable prior art techniques of bump firing and trigger activated techniques popularized by devices like the HELLSTORM 2000 and TAC Trigger in that the firing unit 22 is slidably supported for linear reciprocating movement relative to the stabilized actuator 74 during the moving and re-moving steps, such that the linear reciprocating movement occurs along a constrained linear path P that is generally parallel to the firearm barrel 23. Thus, the firing unit 22 is forced to reciprocate in a linear path P that is generally parallel to the barrel 23 which allows a user to maintain substantially better aim and control over the trajectory of bullets 76 fired from the firearm.

In the standard implementation of the subject shooting method, which may be modified to better suit handicapped users or other non-standard applications, the user's second body part (e.g., right hand) is maintained in continuous operative relationship with the handle 20 (e.g., by way of a firm grasp on the grip portion 52) during the moving and said re-moving steps. In other words, in the standard implementation common to most users, their second body part (e.g., right hand) firmly and continuously holds the handle 20 while their first body part (e.g., left hand) firmly and continuously holds the firing unit 22 (e.g., via the hand guard 72 under the barrel 23). And still further, in the standard implementation the actuator 74 is in fact the index finger of the hand that is holding fast to the grip portion 52, which index finger extends over the finger rest 70 so that the trigger 24 will intermittently collide with the finger in response to linear reciprocating movement of the firing unit 22. This so-called standard implementation is illustrated in FIGS. 1, 14A and 14B. Non-standard implementations would include the substitution of other body parts for the left and/or right hands of the user, as may be preferred for handicapped shooters as well as practiced in various forms by non-handicapped shooters.

Turning again to FIG. 14B, the recoil force is indicated by the large directional arrow 202 lying along a vector parallel to the constrained linear path P. Preferably, but not necessarily, the user will reduce the primary forward activation force 202 while the recoil force 202 is being generated. With or without a force reduction, the user is encouraged to continue the application of a forwardly directed negative-resistance 204 human muscle power through the user's first body part to the firing unit 22 (e.g., left hand via the hand guard 72). In cases where there is a reduction in the primary forward activation force 202, that reduction is discontinued prior to the re-moving step (i.e., before the user generate a secondary forward activation force 200). The negative-resistance 204 typically will have a force value equal to or less than the recoil force 202, but greater than zero. (In some cases of very slow shooting tempos, it may be possible that the negative-resistance 204 can be greater than the immediately adjacent forward activation force 200, provided the negative-resistance 204 remains less than the recoil force 202.) The negative-resistance 204 acts in a direction opposite to the recoil force 202, so that if the negative-resistance 204 were equal to or greater than the recoil force 202 then the firing unit 22 would not travel rearwardly the distance D needed to reset the trigger 24.

The application of the negative-resistance 204 has several advantages. For one, it dampens the return travel of the firing unit 22 thereby having an incremental positive effect on the impact of components in the interface system 54 and bearing element 60. For another, it allows the user to maintain constant forward pressure through the first body part (e.g., left hand), selectively with varying or modulating force, which results in faster muscular reaction time as compared with motions that require direction reversals. Said another way, the user may perform this shooting method extending only one muscle group, or one set of muscle groups continuously (and optionally with modulating force). Exerting continuous extension of the muscle group controlling the user's first body part is a much faster muscular control exercise than trying to alternate two opposing muscle groups (e.g., biceps and triceps) between extension-relaxation modes, thus allowing the firearm to be repeat fired at a faster rate. A still further advantage is that the user can, if desired, change the firing rate tempo on the fly by varying either or both of the forward activation forces 200 or the negative-resistance 204. That is to say, a generally constant firing tempo will be achieved by maintaining a generally constant forward activation force 200 and negative-resistance 204. However, by modulating on-the-fly at least one of the forward activation force 200 and negative-resistance 204, the user can effect a controlled rate change in the number of rounds fired per minute.

With regard to this latter benefit, reference is made to FIG. 21 which represents a simplified time (t) chart showing the relationship between forward and rearward movement of the firing unit 22 in the handle 20. In this illustration, graphic depictions of each ammunition discharge event are identified by the number 210, with the discharge sequence indicated by the suffix letters A, B, C, . . . n. Thus, 210A identifies the first ammunition discharge event, 210B the second discharge event, 210C the third discharge event, and so on. The trigger resetting events are graphically depicted at 220, with the resetting sequence indicated by the suffix letters A, B, C, . . . n. Thus, 220A identifies the trigger resetting event immediately following the first ammunition discharge event 210A, 220B identifies the trigger resetting event immediately following the second ammunition discharge event 210B, and so on. The motion of the firing unit 22 relative to the handle 20 is shown by alternating solid and broken lines extending in sequential zigzag fashion between the discharge 210 and resetting 220 events, starting at 0,0 and working downwardly as viewed from FIG. 21. The solid lines here represent forward motion of the firing unit 22 (moving left to right as viewed from FIG. 21) accomplished by the user's muscle power in the form of the previously described forward activation forces 200. The broken lines here represent rearward motion of the firing unit 22 (moving right to left as viewed from FIG. 21) accomplished by the recoil force 202 as offset by user's muscle power in the form of the previously described negative resistance 204.

Careful attention to FIG. 21 will reveal that the firing rate or tempo between and among discharge events 210A-210D is substantially equal even though the time period between trigger resetting events 220A-220B is longer than the time period between trigger resetting events 220B-220C. This may at first seem counter-intuitive, but is in fact one indication enabled by the subject invention—that a user may maintain constant firing tempo by modulating, on-the-fly, their forward activation forces 200 relative to their negative resistance 204. And by extension, the user may also vary the tempo of the firing rate by modulating, on-the-fly, their forward activation forces 200 relative to their negative resistance 204. An example of varied firing rates may be seen by comparison of the time span between discharge events 210E-210F and 210E-210G. Thus, by proportionally increasing their forward activation forces 200 and/or decreasing the negative resistance 204, the firing rate of the firearm can be made faster. And conversely by proportionally decreasing their forward activation forces 200 and/or increasing the negative resistance 204, the firing rate of the firearm can be slowed. With subtle variations in muscle control, a user can change the burst speed of ammunition between exceptionally fast and essentially single shot conditions. With practice, a user can predetermine the number of rounds to be discharged in a particular burst, e.g., 3-round or 5-round bursts, and achieve that intent through the careful control of their muscles.

FIG. 22 reinforces this phenomenon by illustrating, in simplified form, the various forces along the constrained linear path P versus time (t) for the resetting and discharge events from 220E-210H as per the FIG. 21 example above. The force along the constrained linear path P is a composition of forward activation forces 200, recoil forces 202, and negative-resistance 204. In comparing the forward activation force 200F immediately following trigger reset 220E to the forward activation force 200G immediately following trigger reset 220F, in can be observed that the greater force 200G results in a shorter time for the firing unit 22 to traverse the distance D (i.e., to move between trigger rest 220F and discharge event 210G). This follows naturally from the well-known equation: Force=mass*acceleration. Where the traveling distance D is fixed, an increase in force (on a firing unit 22 having constant mass) results in a corresponding increase in acceleration which is accompanied by a proportional decrease in travel time and vice versa. A similar observation can be appreciated by comparing the forward activation force 200G to forward activation force 200H. Conversely, however, greater force exerted by the user during the negative-resistance 204 phases results in a longer time for the firing unit 22 to traverse the distance D. Compare for example the time intervals between the lower negative-resistance 204F and the higher negative-resistance 204G. This is because the negative-resistance acts against the recoil force 202 and opposite to the traveling direction of the firing unit 22, thus causing the firing unit 22 to traverse the distance D more slowly. It will be noted that the recoil forces 202 are generally assumed to be equal when the same type and specification of ammunition is used to fire successive rounds.

Accordingly, FIG. 22 shows how changes in forward muscle force (200 and/or 202) will result in direct and corresponding changes to the firing tempo of the firearm. Rapid fire mode can be sustained for as long as the ammo supply lasts. Throughout an extended rapid-fire volley, the user will typically maintain forwardly directed muscle force on the firing unit 22, which forwardly directed force may modulate in intensity between highs and lows of the activation 200 and negative-resistance 204 phases. Or, the shooter may simply choose to maintain a generally constant forwardly directed force and not modulate between highs and lows, in which case the firing tempo will remain generally constant. When practicing this method, the shooter's arm (or other first body part) acts something like a spring, or perhaps like the leg muscles of a down-hill skier, constantly extending and absorbing the impact of recoil forces 202. Because the firing cycles occur so rapidly in comparison to human reaction times, the user will fall into a natural rhythm of shooting in rapid succession with a constantly applied forward muscle force that is comfortable, accurate, easy to learn, and infinitely variable in response to slight on-the-fly muscular changes willed by the shooter.

Furthermore, the user's forward activation forces 200 are always aligned in a vector parallel to the barrel 23, which means that during sustained firing of multiple rounds of ammunition in succession from a semi-automatic firearm, the user is continuously redirecting the barrel 23 (relative to the anchored second body part) in the aiming direction of the target. As a result, if the barrel 23 lifts under the recoil forces 204 characteristic with most if not all high-powered rifles, the user's muscular action (via the first body part) required to bring about the very next discharge event 210 will tend to pull the barrel 23 back in line with the intended target. One can imagine that in rapid fire mode, where discharges 210 may occur at rates of several rounds per second, every forward activation force 200 incrementally re-aligns the barrel 23 toward the object at which the shooter is aiming.

Consequently, substantially more accurate, more controlled, and hence more safe shooting can occur in rapid fire mode using the principles of this invention.

Accordingly, in the rapid fire mode, human muscle effort is used to push the firing unit 22 forward while the handle 20 is held generally stationary against the shooter's body. In the standard implementation, the operator places a first body part (such as a left hand in the case of a right-handed shooter) on a hand guard 72 under the barrel 23, and another body part (such as the right hand of a right-handed shooter) on the grip 52 of the handle 20. The user presses the butt end 32 of the shoulder stock 26 tightly against their body (for example the right shoulder of a right-handed shooter). This standard grip is illustrated in FIGS. 1, 14A and 14B in the context of a right-handed shooter. Of course, other configurations of the invention are conceivable in which a single hand (or other body part) is used to supply the human effort needed to both push the firing unit 22 forward while the handle 20 remains stationary relative to another body part. This may be accomplished by suitable push-rod or lever mechanisms, or other manually controlled constructions. In the case of a handicapped operator that does not have use of one or perhaps even both arms, the device may be configured to allow an operator to apply other forms of muscle effort, such as from a leg, neck, or torso. In these examples, leg, neck, or torso comprises the first body part. In all such cases, it is preferred that human muscle effort is the primary (if not exclusive) source of energy for moving the firing unit 22 forward against the recoil energy of a fired bullet 76. The act of holding the handle 20 stationary may, if desired, be accomplished by a fixed mounting arrangement such as by a shooting table or rest. The optional stationary mounting configuration may be preferred by disabled sportsmen, for example, as a convenience. Amputees, quadriplegics, and others that may be challenged to manipulate objects requiring the use of their fingers previously had limited options to assist them when operating a firing unit. The subject invention enables these individuals to operate the firing unit 22 without the need to manipulate small and delicate parts as was typical in prior art shooting systems. Thus, in cases where the handle 20 is held stationary by means of some fixed mounting arrangement, the user's first body part may comprise a hand, arm, leg or shoulder (for examples), and the second body part may comprise the portion of their body that is anchored relative to the handle 20, such as their torso in a chair.

Returning again to the most typical applications of this invention, the operator shoulders the firing unit 22 or otherwise positions the firing unit 22 to be fired at an intended target. At this stage, the firing unit 22 and handle 20 are manually compressed together so that the trigger 24 is recessed behind the finger rest 70. When the operator (i.e., the shooter) is ready to discharge a round, he or she firmly places a finger 74 in the scalloped portion of the finger rest 70 of the trigger guard 66. Any applicable safety switch is moved to a FIRE condition, and then the operator applies human effort to push the hand guard 72 of the firing unit 22 longitudinally forward so as to move the firing unit 22 forward relative to the handle 20. Simultaneously with this action, the operator securely holds the handle 20 (or it is held in place by a suitable mount) so that it does not move together with the firing unit 22. All the while, the operator's finger 74 is held fast against the rest 70. The trigger guard 66 holds the finger 74 away from the trigger 24 until the firing unit 22 travels forwardly the predetermined distance D, at which point, the trigger 24 collides with the finger 74 in the finger rest 70, thereby activating the trigger 24 and discharging a bullet 76 from the firing unit 22. As explained above, a cross-pin or any other comparable object could be substituted for the finger 74 for activating the trigger 24. Since there is no movement of the operator's finger 74 during bump firing, the intentional forward movement of the firing unit 22 is considered responsible for triggering the fire control mechanism of the firing unit 22. In other words, the muscular application of force to create forward movement of the firing unit 22 defines the volitional act of the shooter to discharge each individual round of ammunition. Each discharge requires a separate volitional decision of the operator to exert his or her body strength to move the firing unit 22 back to a firing condition.

The discharge 210 of the bullet 76 creates a recoil 202 in the firing unit 22 that pushes the firing unit 22 longitudinally backward relative to the handle 20, thereby resetting the trigger 24. The firing unit 22 stops moving backward as soon as the recoil energy 202 subsides to the point at which it is counterbalanced by the human effort 204 that is urging the firing unit 22 forwardly, such as by a hand pushing the hand guard 72 forwardly. In any event, the firing unit 22 will stop moving backward if the bearing element 60 strikes the back 56 of the interface system 54 of the grip portion 52. Because the trigger 24 has been reset automatically during backward travel of the firing unit 22, the operator's muscle power 200 pushing the hand guard 72 of the firing unit 22 forwardly will bring the trigger 24 and finger 74 back into collision and cause the firing unit 22 to discharge another round of ammunition 210.

As can be predicted, in the rapid fire mode a fairly brisk rate of firing can be achieved by rhythmically applying forward forces 200, 204 on the hand guard 72 of the firing unit 22. However, the negative-resistance phase 204 of the forward force must not be so great as to overcome the recoil force 202 generated by expanding gases in the discharged bullet 76. For example, if a particular bullet 76 creates a recoil energy 202 of 15 lbf in the firing unit 22, then the negative resistance 204 applied to the hand guard 72 must be less than 15 lbf so that the firing unit 22 is able to move backward by the predetermined distance D and allow the trigger 24 to reset 220. If the operator applies a negative resistance 204 on the hand guard 72 greater than 15 lbf in this example, then the firing unit 22 will not slide rearwardly by any appreciable distance and the trigger 24 will not reset. In other words, the operator will have overpowered the recoil energy 202 from the discharge 210.

An experienced user of this invention thus will develop a new and interesting shooting form by which their human muscle effort applied to separate the firing unit 22 and handle 20 will be temporarily decreased substantially simultaneously with the recoil of the firing unit 22, thereby allowing the firing unit 22 to slide backward in the handle 20 so that the trigger 24 has a chance to reset. If the user decides to decrease their application of muscular force to zero or nearly zero during the recoil event, the firing unit 22 will slide rearwardly quite rapidly with the bearing element 60 arresting movement when it bottoms in the interface system 54. Naturally, this is not a recommended way to operate the firing unit 22 because the service life of the components may be reduced with hash impacts. Once the trigger 24 is reset, the user will then increase their muscle effort to separate the firing unit 22 and handle 20 and thereby rapidly return the firing unit to a firing condition.

In the preferred or recommended method of rapid firing according to the principles of this invention, the operator's application of muscular force 200, 204 to separate the firing unit 22 and handle 20 will fluctuate between a minimum value during the recoil event and a maximum value commencing as soon as the trigger 24 has moved the predetermined distance D. The minimum value will provide a degree of resistance to the recoiling firing unit 22 sufficient to arrest its rearward movement before the bearing element 60 bottoms in its interface system 54 but not so great as to prevent full resetting of the trigger 24. The maximum value must be large enough to return the firing unit 22 to a firing condition while maintaining full and graceful control of the firing unit 22. In this way, a rhythmic shooting style can be learned that adds a new enjoyment and excitement to the sport of shooting firing units, and which remains under uninterrupted control of human muscle power. In other words, if at any time during the rapid firing mode an operator does not apply sufficient effort to separate the firing unit 22 and handle 20, the firing unit 22 will immediately cease firing thus making the rapid firing mode of operation dependent on an actively engaged operator.

Because the shooter will intuitively learn to adjust the effort applied to separate the firing unit 22 and handle 20 in bump-fire mode, the type of ammunition used will not affect the functionally of the subject invention. As an example, it is well known that three otherwise identical AR-15 style semi-automatic firing units 22 can be chambered for different calibers, such as .223, 7.62×39, 9 mm, etc. Each of these ammunition types will produce a substantially different amount of recoil energy. However, the same handle 20 of the subject invention can be fitted to all three of these firing units 22, without alteration, and operate flawlessly in bump-fire mode with the only change being slight variations in muscle effort applied by the shooter in response to the varying recoil energies produced by the three separate rounds of ammunition. The invention thus introduces an opportunity for new muscle control techniques in the shooting arts that can be fostered with practice so as to develop previously unknown skills and nuances. The novel shooting method of this invention, which includes manually moving the firing unit 22 forwardly relative to the handle 20 by the predetermined distance D, has the potential to invigorate the shooting sports with new interest, competitions, discussion forums and fun.

FIG. 11 shows a side view of the trigger guard 66 and the trigger 24 while the firing unit 22 is operated in the rapid fire mode. The solid lines show the trigger 24 in a first position after the recoil has pushed the firing unit 22 longitudinally backward to the point where the bearing element 60 has struck the back 56 of the interface system 54. The dashed lines show the trigger 24 in a second position after the firing unit 22 has been pushed longitudinally forward relative to the handle 20 by the predetermined distance D to collide the trigger 24 with the operator's finger 74. In other words, the predetermined distance D is the distance that the trigger 24 moves from the first position to the second position. It should be appreciated that the bearing element 60 and buffer tube 30 also move longitudinally forward and backward relative to the handle 20 by the predetermined distance D when the firing unit 22 is fired in the rapid fire mode. It should be understood that in rapid fire mode, the shooter's own application of longitudinally forward movement is primarily, if not solely, responsible for activating the firing mechanism. The operator's finger 74, or other stationary object, performs no volitional action during rapid firing but rather acts as a dumb link in the firing cycle. In other words, a person with a paralyzed trigger finger 74 is able to rapid fire a firing unit 22 according to this invention with equal effectiveness as would a shooter having normal dexterity in their trigger finger 74. This is because the operator's trigger finger 74 does not squeeze the trigger 24 during the rapid firing mode; it is merely held firmly against the rest 70.

To switch to the standard fire mode, the operator simply changes the lock 44 from the open position to the locked position. The operator may now place the butt end 32 of the shoulder stock 26 firmly against his or her shoulder. The trigger 24 is accessible on the side opposite the trigger guard 66. Because the handle 20 and firing unit 22 are locked together by the lock 44, the trigger 24 cannot travel longitudinally forward to collide with the operator's finger 74. The operator's finger 74 must be placed directly on the trigger 24, and a longitudinally backward pressure must be applied on the trigger 24 to discharge the firing unit 24.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A sliding bump stock for a semi-automatic firearm, said stock comprising:

a handle adapted to be grasped by a user's hand, said handle including a finger rest, said finger rest extending forwardly from said handle and configured to stabilize the end of a user's trigger finger in a partially extended condition so that in use the user's trigger finger stretches in front of the trigger while the remaining fingers of the user's hand grasp said handle, said finger rest and said handle being moveable together as a unit, said handle including an opposing surface for directly interacting with a bearing element of the firearm so that said finger rest and said handle are able to reciprocate in concert relative to the firearm trigger back-and-forth along a constrained linear path, and a lock movable toward and away from a locked position for selectively stopping reciprocating movement of said finger rest relative to the firearm trigger.

2. The stock of claim 1, wherein said lock includes a retractable pin.

3. The stock of claim 2, wherein said lock includes spring acting between said retractable pin and said handle.

4. The stock of claim 2, wherein said lock includes cam acting between said retractable pin and said handle.

5. The stock of claim 4, wherein said handle includes a shoulder stock having an undersurface, said undersurface including a recessed portion, said cam directly engageable with said recessed portion.

6. The stock of claim 5, wherein said cam is rotatably disposed relative to said handle and configured to displace said retractable pin away from said locked position in less than 180 degrees of rotation.

7. The stock of claim 4, wherein said cam is rotatably disposed relative to said handle and is fixed relative to said retractable pin such that rotation of said cam causes a corresponding rotation of said pin.

8. The stock of claim 1, wherein said at least one opposing surface comprises a channel formed in said handle and having an open front and a closed back, said channel configured to matingly receive the bearing element.

9. The assembly of claim 8, wherein said channel has a generally continuous cross-sectional inner profile extending rearwardly from said open front.

10. The assembly of claim 1, wherein said handle includes a pistol grip and a shoulder stock, said finger rest extending forwardly of said shoulder stock.

11. A sliding bump stock and interface system assembly for a semiautomatic firearm, said assembly comprising:

a bearing element adapted for attachment to a semi-automatic firearm to establish a constrained linear path of reciprocation, a handle adapted to be grasped by a user's hand, said handle including a finger rest, said finger rest configured to stabilize the end of a user's trigger finger in a partially extended condition so that in use the user's trigger finger stretches in front of the trigger while the remaining fingers of the user's hand grasp said handle, said finger rest and said handle being fixed together as a unit, said handle including an opposing surface for directly interacting with said bearing element so that said finger rest and said handle are able to reciprocate in concert relative to said bearing element back-and-forth along said constrained linear path, and a lock movable toward and away from a locked position for selectively arresting reciprocating movement of said handle relative to said bearing element.

12. The assembly of claim 11, wherein said lock includes a cam rotatably disposed relative to said handle.

13. The assembly of claim 12, wherein said cam is configured to fully displace a retractable pin within less than 180 degrees of rotation of said cam relative to said handle.

14. The assembly of claim 12, wherein said handle includes a shoulder stock having an undersurface, said undersurface including a recessed portion, said cam directly engageable with said recessed portion when said cam is rotated relative to said handle.

15. The assembly of claim 11, wherein said at least one opposing surface comprises a channel formed in said handle and having an open front and a closed back, said channel configured to matingly receive said bearing element.

16. The assembly of claim 11, wherein said lock includes a retractable pin.

17. The assembly of claim 16, wherein said bearing element includes at least one detent, said retractable pin selectively insertable into said detent to arrest movement of said handle relative to said bearing element.

18. The assembly of claim 16, wherein said bearing element includes a track, said track terminating at a rear stop, a tip of said retractable pin being disposed within said track and engageable with said rear stop to limit overtravel of said handle.

19. The assembly of claim 16, wherein said lock includes spring acting between said retractable pin and said handle.

20. The assembly of claim 11, wherein said lock includes a retractable pin having a tip, said bearing including a track, said track terminating at a rear stop, a tip of said retractable pin being disposed within said track and engageable with said rear stop to limit overtravel of said handle, at least one detent associated with said track, said tip of said retractable pin selectively insertable into said detent.

* * * * *